US006866725B2

(12) United States Patent
Fujita et al.

(10) Patent No.: US 6,866,725 B2
(45) **Date of Patent: *Mar. 15, 2005**

(54) STEEL PIPE EXCELLENT IN FORMABILITY AND METHOD OF PRODUCING THE SAME

(75) Inventors: Nobuhiro Fujita, Futtsu (JP); Naoki Yoshinaga, Futtsu (JP); Manabu Takahashi, Futtsu (JP); Hitoshi Asahi, Futtsu (JP); Yasuhiro Shinohara, Futtsu (JP); Yasushi Hasegawa, Tokai (JP)

(73) Assignee: Nippon Steel Corporation, Tokyo (JP)

( * ) Notice: Subject to any disclaimer, the term of this patent is extended or adjusted under 35 U.S.C. 154(b) by 16 days.

This patent is subject to a terminal disclaimer.

(21) Appl. No.: 10/220,441

(22) PCT Filed: Feb. 28, 2001

(86) PCT No.: PCT/JP01/01530

§ 371 (c)(1),
(2), (4) Date: Aug. 27, 2002

(87) PCT Pub. No.: WO01/62998

PCT Pub. Date: Aug. 30, 2001

(65) Prior Publication Data

US 2003/0116238 A1 Jun. 26, 2003

(30) Foreign Application Priority Data

| | | |
|---|---|---|
| Feb. 28, 2000 | (JP) | 2000-052574 |
| Jun. 9, 2000 | (JP) | 2000-174371 |
| Jun. 19, 2000 | (JP) | 2000-183662 |
| Oct. 27, 2000 | (JP) | 2000-328156 |

(51) Int. Cl.[7] ..... C22C 38/02; C22C 38/04; C21D 8/10

(52) U.S. Cl. ..... 148/320; 148/330; 148/333; 148/334; 148/335; 148/336; 148/590; 148/909

(58) Field of Search ..... 148/320, 330, 148/332–336, 590, 909

(56) References Cited

U.S. PATENT DOCUMENTS 6,632,296 B2 * 10/2003 Yoshinaga et al. ..... 148/320

FOREIGN PATENT DOCUMENTS

| | | |
|---|---|---|
| JP | 5-86419 | 4/1993 |
| JP | 5-212439 | 8/1993 |
| JP | 9-196244 | 7/1997 |
| JP | 10-52713 | 2/1998 |

* cited by examiner

*Primary Examiner*—Deborah Yee
(74) *Attorney, Agent, or Firm*—Kenyon & Kenyon

(57) ABSTRACT

The present invention is a high strength steel pipe excellent in formability in hydroforming and similar forming methods, characterized by: containing, in mass, C of 0.0005 to 0.30%, Si of 0.001 to 2.0%, Mn of 0.01 to 3.0% and appropriate amounts of other elements if necessary, with the balance consisting of Fe and unavoidable impurities; and an average for the ratios of the X-ray strength in the orientation component group of {110}<110> to {111}<110> to random X-ray diffraction strength on a plane at the wall thickness center being 2.0 or more and/or a ratio of the X-ray strength in the orientation component of {110}<110> to random X-ray diffraction strength on the plane at the wall thickness center being 3.0 or more.

34 Claims, No Drawings

STEEL PIPE EXCELLENT IN FORMABILITY AND METHOD OF PRODUCING THE SAME

TECHNICAL FILED

The present invention relates to a steel material used for, for example, undercarriage components, structural members, etc. of an automobile or the like and, in particular, a high strength steel pipe excellent in formability in hydroforming or the like, and to a method of producing the same.

BACKGROUND ART

The strengthening of a steel sheet has been desired with the growing demands for weight reduction in automobiles. The strengthening of a steel sheet makes it possible to reduce the weight of an automobile through the reduction of material thickness and also to improve collision safety. Attempts have been made recently to form a material steel sheet or pipe of a high strength steel into components of complicated shapes by the hydroforming method for the purpose of reducing the number of components or welded flanges, in response to the demands for the weight reduction and cost reduction of an automobile. Actual application of new forming technologies, such as the hydroforming method (see Japanese Unexamined Patent Publication No. H10-175027), is expected to bring about great advantages such as the reduction of costs and increase in the degree of freedom in design work.

In order to fully enjoy the advantages of the hydroforming method, new materials suitable for the new forming methods are required. For instance, the influence of r-value on the hydroforming work was disclosed at the $50^{th}$ Japanese Joint Conference for the Technology of Plasticity (in 1999, p. 447 of its proceedings). What was disclosed was, however, that, based on an analysis by a simulation, the r-value in the longitudinal direction was effective for T-shape forming, which was one of the fundamental forming modes of hydroforming. Apart from the above, as reported at FISITA World Automotive Congress, 2000A420 (Jun. 12–15, 2000, at Seoul), a high formability steel pipe was being developed aiming at realizing high strength and high ductility by forming fine crystal grains. The improvement of the r-value in the longitudinal direction of a steel pipe was also discussed in the report.

However, while the formation of fine crystal grains is very effective for securing ductility of thick materials, considering the points that, according to the report, fine crystal grains are obtained by warm working at comparatively low temperatures and that a heavy draft (the ratio of diameter reduction or area reduction, in this case) is applied during the working, it is possible that the reported method lowers the n-value, which is important for the forming by hydroforming and similar methods, and does not increase average r-value, which is an indicator of formability.

As reviewed above, there are very few cases of practical developments of materials suitable not only for a certain basic forming mode such as hydroforming or the like but also for various forming modes. Thus, in the absence of suitable materials, conventional high r-value steel sheets and high ductility steel sheets are used for the hydroforming applications.

DISCLOSURE OF THE INVENTION

The present invention provides a steel pipe excellent in formability in hydroforming and similar forming methods and a method of producing the steel pipe by specifying the characteristics of the steel material for the pipe.

The present inventors identified the metallographic structure and texture of a steel material excellent in formability in hydroforming and similar forming methods and a method for controlling the metallographic structure and texture. On this basis, the present invention provides a steel pipe excellent in formability in hydroforming and similar forming methods and a method of producing the steel pipe, by specifying the structure and texture and the method for controlling them.

The gist of the present invention, therefore, is as follows:

(1) A steel pipe excellent in formability characterized by: containing, in mass, C: 0.0005 to 0.30%, Si: 0.001 to 2.0%, Mn: 0.01 to 3.0%, with the balance consisting of Fe and unavoidable impurities; and the average for the ratios of the X-ray strength in the orientation component group of {110}<110> to {111}<110> to random X-ray diffraction strength on a plane at the wall thickness center being 2.0 or more and/or the ratio of the X-ray strength in the orientation component of {110}<110> to random X-ray diffraction strength on a plane at the wall thickness center being 3.0 or more.

(2) A steel pipe excellent in formability according to the item (1), characterized by further containing, in the steel, one or more of Al, Zr and Mg at 0.0001 to 0.5 mass % in total.

(3) A steel pipe excellent in formability according to the item (1) or (2), characterized by further containing, in the steel, one or more of Ti, V and Nb at 0.001 to 0.5 mass % in total.

(4) A steel pipe excellent in formability according to any one of the items (1) to (3), characterized by further containing P at 0.001 to 0.20 mass % in the steel.

(5) A steel pipe excellent in formability according to any one of the items (1) to (4), characterized by further containing B at 0.0001 to 0.01 mass % in the steel.

(6) A steel pipe excellent in formability according to any one of the items (1) to (5), characterized by further containing in the steel one or more of Cr, Cu, Ni, Co, W and Mo at 0.001 to 1.5 mass % in total.

(7) A steel pipe excellent in formability according to any one of the items (1) to (6), characterized by further containing in the steel one or more of Ca and a rare earth element (Rem) at 0.0001 to 0.5 mass % in total.

(8) A steel pipe excellent in formability according to any one of the items (1) to (7), characterized in that: ferrite accounts for 50% or more, in terms of area percentage, of the metallographic structure; the crystal grain size of the ferrite is within the range from 0.1 to 200 $\mu$m; and the average for the ratios of the X-ray strength in the orientation component group of {110}<110> to {111}<110> to random X-ray diffraction strength on a plane at the wall thickness center is 2.0 or more and/or the ratio of the X-ray strength in the orientation component of {110}<110> to random X-ray diffraction strength on a plane at the wall thickness center is 3.0 or more.

(9) A steel pipe excellent in formability characterized by satisfying either one or both of the following properties:

(1) the n-value in the longitudinal direction of the pipe being 0.12 or more, and (2) the n-value in the circumferential direction of the pipe being 0.12 or more.

(10) A steel pipe excellent in formability according to the item (9), characterized by the property of the r-value in the longitudinal direction of the pipe being 1.1 or more.

(11) A steel pipe excellent in formability characterized in that the texture of the steel pipe satisfies one or more of the following conditions ① to ③:

① at least one or more of the following ratios being 3.0 or more: the ratio of the X-ray strength in the orientation component of {111}<110> to random X-ray diffraction strength on a plane at the wall thickness center; the average for the ratios of the X-ray strength in the orientation component group of {110}<110> to {332}<110> to random X-ray diffraction strength on a plane at the wall thickness center; and the ratio of the X-ray strength in the orientation component of {110}<110> to random X-ray diffraction strength on a plane at the wall thickness center, ② at least either one or both of the following ratios being 3.0 or less: the average for the ratios of the X-ray strength in the orientation component group of {100}<110> to {223}<110> to random X-ray diffraction strength on a plane at the wall thickness center; and the ratio of the X-ray strength in the orientation component of {100}<110> to random X-ray diffraction strength on a plane at the wall thickness center, and ③ at least either one or both of the following conditions being satisfied: the average for the ratios of the X-ray strength in the orientation component group of {111}<110> to {111}<112> and {554}<225> to random X-ray diffraction strength on a plane at the wall thickness center being 2.0 or more; and the ratio of the X-ray strength in the orientation component of {111}<110> to random X-ray diffraction strength on a plane at the wall thickness center being 3.0 or more.

(12) A steel pipe excellent in formability according to any one of the items (9) to (11), characterized by containing ferrite at 50% or more in terms of area percentage and the grain size of the ferrite being in the range from 0.1 to 200 μm.

(13) A steel pipe excellent in formability according to any one of the items (9) to (12), characterized by: containing ferrite at 50% or more in terms of area percentage; the grain size of the ferrite ranging from 1 to 200 μm; and the standard deviation of the distribution of the grain size falling within the range of ±40% of the average grain size.

(14) A steel pipe excellent in formability according to any one of the items (9) to (13), characterized by: containing ferrite by 50% or more in terms of area percentage; and the average for the aspect ratios (the ratio of the grain length in the longitudinal direction to the grain thickness in the thickness direction) of ferrite grains being in the range from 0.5 to 3.0.

(15) A steel pipe excellent in formability according to any one of the items (9) to (14), characterized by containing, in mass, C: 0.0005 to 0.30%, Si: 0.001 to 2.0%, Mn: 0.01 to 3.0%, P: 0.001 to 0.20%, and N: 0.0001 to 0.03%, with the balance consisting of Fe and unavoidable impurities.

(16) A steel pipe excellent in formability according to the item (15), characterized by further containing in the steel, in mass, one or more of Ti: 0.001 to 0.5%, Zr: 0.001 to 0.5% or less, Hf: 0.001 to 2.0% or less, Cr: 0.001 to 1.5% or less, Mo: 0.001 to 1.5% or less, W: 0.001 to 1.5% or less, V: 0.001 to 0.5% or less, Nb: 0.001 to 0.5% or less, Ta: 0.001 to 2.0% or less, and Co: 0.001 to 1.5% or less.

(17) A steel pipe excellent in formability according to the item (15) or (16), characterized by further containing in the steel, in mass, one or more of B: 0.0001 to 0.01%, Ni 0.001 to 1.5%, and Cu: 0.001 to 1.5%.

(18) A steel pipe excellent in formability according to any one of the items (15) to (17), characterized by further containing in the steel, in mass, one or more of Al: 0.001 to 0.5%, Ca: 0.0001 to 0.5%, Mg: 0.0001 to 0.5%, and Rem: 0.0001 to 0.5%.

(19) A method of producing a steel pipe excellent in formability according to any one of the items (1) to (18), characterized by forming a mother pipe using a hot-rolled or cold-rolled steel sheet satisfying any one or more of the following conditions ① to ④ as the material sheet, then heating the mother pipe to a temperature in the range from the $Ac_3$ transformation point to 200° C. above the $Ac_3$ transformation point, and then subjecting it to diameter reduction work in the temperature range from 900 to 650° C.:

① at least either one or both of the following conditions being satisfied: the average for the ratios of the X-ray strength in the orientation component group of {110}<110> to {111}<110> to random X-ray diffraction strength on a plane at the wall thickness center being 2.0 or more; and the ratio of the X-ray strength in the orientation component of {110}<110> to random X-ray diffraction strength on a plane at the wall thickness center being 3.0 or more, ② at least one or more of the following ratios being 3.0 or more: the ratio of the X-ray strength in the orientation component of {111}<110> to random X-ray diffraction strength on a plane at the wall thickness center; the average for the ratios of the X-ray strength in the orientation component group of {110}<110> to {332}<110> to random X-ray diffraction strength on a plane at the wall thickness center; and the ratio of the X-ray strength in the orientation component of {110}<110> to random X-ray diffraction strength on a plane at the wall thickness center, ③ at least either one or both of the following ratios being 3.0 or less: the average for the ratios of the X-ray strength in the orientation component group of {100}<110> to {223}<110> to random X-ray diffraction strength on a plane at the wall thickness center; and the ratio of the X-ray strength in the orientation component of {100}<110> to random X-ray diffraction strength on a plane at the wall thickness center, and ④ at least either one or both of the following conditions being satisfied: the average for the ratios of the X-ray strength in the orientation component group of {111}<110> to {111}<112> and {554}<225> to random X-ray diffraction strength on a plane at the wall thickness center being 2.0 or more; and the ratio of the X-ray strength in the orientation component of {111}<110> to random X-ray diffraction strength on a plane at the wall thickness center being 3.0 or more.

(20) A method of producing a steel pipe excellent in formability according to any one of the items (1) to (18), characterized by forming a mother pipe using a hot-rolled or cold-rolled steel sheet satisfying any one or more of the following conditions ① to ④ as the material sheet, and then applying heat treatment to the mother pipe at a temperature in the range from 650° C. to 200° C. above the $Ac_3$ transformation point:

① at least either one or both of the following conditions being satisfied: the average for the ratios of the X-ray strength in the orientation component group of {110}<110> to {111}<110> to random X-ray diffraction strength on a plane at the wall thickness center being 2.0 or more; and the ratio of the X-ray strength in the orientation component of {110}<110> to random X-ray diffraction strength on a plane at the wall thickness center being 3.0 or more, ② at least one or more of the following ratios being 3.0 or more: the ratio of the X-ray strength in the orientation component of {111}<110> to random X-ray diffraction strength on a plane at the wall thickness center; the average for the ratios of the X-ray strength in the orientation component group of {110}<110> to {332}<110> to random X-ray diffraction strength on a plane at the wall thickness center; and the ratio of the X-ray strength in the orientation component of {110}<110> to random X-ray diffraction strength on a plane at the wall thickness center, ③ at least either one or both of the following ratios being 3.0 or less: the average for the ratios of the X-ray strength in the orientation component group of {100}<110> to {223}<110> to random X-ray diffraction strength on a plane at the wall thickness center; and the ratio of the X-ray strength in the orientation component of {100}<110> to random X-ray diffraction strength on a plane at the wall thickness center, and (4) at least either one or both of the following conditions being satisfied: the average for the ratios of the X-ray strength in the orientation component group of {111}<110> to {111}<112> and {554}<225> to random X-ray diffraction strength on a plane at the wall thickness center being 2.0 or more; and the ratio of the X-ray strength in the orientation component of {111}<110> to random X-ray diffraction strength on a plane at the wall thickness center being 1.5 or more.

(21) A steel pipe excellent in formability characterized by satisfying either one or both of the following properties:

(1) the n-value in the longitudinal direction of the pipe being 0.18 or more, and (2) the n-value in the circumferential direction of the pipe being 0.18 or more.

(22) A steel pipe excellent in formability according to the item (21), characterized by having the property of the r-value in the longitudinal direction of the pipe being 0.6 or more but less than 2.2.

(23) A steel pipe excellent in formability according to the item (21) or (22), characterized in that the ratio of X-ray strength to random X-ray diffraction strength satisfies the following two conditions:

① the average for the ratios of the X-ray strength in the orientation component group of {110}<110> to {111}<110> to random X-ray diffraction strength on a plane at the wall thickness center being 1.5 or more, and ② the ratio of the X-ray strength in the orientation component of {110}<110> to random X-ray diffraction strength on a plane at the wall thickness center being 5.0 or less.

(24) A steel pipe excellent in formability according to any one of the items (21) to (23), characterized in that the ratio of the X-ray strength in the orientation component of {111}<110> to random X-ray diffraction strength on a plane at the wall thickness center is 3.0 or more.

(25) A steel pipe excellent in formability according to any one of the items (21) to (24), characterized by containing ferrite by 50% or more in terms of area percentage and the grain size of the ferrite being in the range from 0.1 to 200 μm.

(26) A steel pipe excellent in formability according to any one of the items (21) to (25), characterized by: containing ferrite by 50% or more in terms of area percentage; and the average for the aspect ratios (the ratio of the grain length in the longitudinal direction to the grain thickness in the thickness direction) of ferrite grains being in the range from 0.5 to 3.0.

(27) A steel pipe excellent in formability according to any one of the items (21) to (26), characterized by containing, in mass, C: 0.0005 to 0.30%, Si: 0.001 to 2.0%, Mn: 0.01 to 3.0%, and N: 0.0001 to 0.03%, with the balance consisting of Fe and unavoidable impurities.

(28) A steel pipe excellent in formability according to any one of the items (21) to (27), characterized by further containing in the steel pipe one or more of Al, Zr and Mg at 0.0001 to 0.5 mass % in total.

(29) A steel pipe excellent in formability according to any one of the items (21) to (28), characterized by further containing in the steel pipe one or more of Ti, V and Nb at 0.001 to 0.5 mass % in total.

(30) A steel pipe excellent in formability according to any one of the items (21) to (29), characterized by further containing P at 0.001 to 0.20 mass % in the steel pipe.

(31) A steel pipe excellent in formability according to any one of the items (21) to (30), characterized by further containing B at 0.0001 to 0.01 mass % in the steel pipe.

(32) A steel pipe excellent in formability according to any one of the items (21) to (31), characterized by further containing in the steel pipe one or more of Cr, Cu, Ni, Co, W and Mo at 0.001 to 5.0 mass % in total.

(33) A steel pipe excellent in formability according to any one of the items (21) to (32), characterized by further containing in the steel pipe one or more of Ca and a rare earth element (Rem) at 0.0001 to 0.5 mass % in total.

(34) A method of producing a steel pipe excellent in formability according to any one of the items (21) to (33), characterized by forming a mother pipe, then heating it to a temperature in the range from 50° C. below the $Ac_3$ transformation point to 200° C. above the $Ac_3$ transformation point, and then subjecting it to diameter reduction work in the temperature range from 650 to 900° C. at a diameter reduction ratio of 10 to 40%.

BEST MODE FOR CARRYING OUT THE INVENTION

The present invention is explained hereafter in detail. The invention according to the item (1) is explained in the first place.

The contents of elements in the explanations below are in mass percentage.

C: C is effective for increasing steel strength and, hence, 0.0005% or more of C is added but, since an addition of C in a large quantity is undesirable for controlling steel texture, the upper limit of its addition is set at 0.30%.

Si: Si is an element for increasing strength and deoxidizing steel as well and, therefore, its lower limit is set at 0.001%. An excessive addition of Si, however, leads to the deterioration of wettability in plating and workability and, for this reason, the upper limit of the Si content is set at 2.0%.

Mn is an element effective for increasing steel strength and therefore the lower limit of its content is set at 0.01%. The upper limit of the Mn content is set at 3.0%, because its excessive addition lowers ductility.

The ratios of X-ray strength in orientation component group of {110}<110> to {111}<110> and orientation component of {110}<110> to random X-ray diffraction strength on plane at a wall thickness center constitute the property figures most strongly required in the application of hydroforming. The average for the ratios of the X-ray strength in the orientation component group of {110}<110> to {111}<110> to random X-ray diffraction strength, which ratios being obtained by an X-ray diffraction measurement on a plane at the wall thickness center, is determined to be 2.0 or more.

The main orientations included in this orientation component group are {110}<110>, {661}<110>, {441}<110>, {331}<110>, {221}<110>, {332}<110>, {443}<110>, {554}<110> and {111}<110>.

The ratios of the X-ray strength in these orientations to random X-ray diffraction strength can be calculated from the three-dimensional texture calculated by the vector method based on the pole figure of {110}, or the three-dimensional texture calculated by the series expansion method based on two or more pole figures of {110}, {100}, {211} and {310}.

For example, in case of obtaining the ratios of the X-ray strength in the crystal orientation components to random X-ray diffraction strength by the latter method, the ratios can be represented by the strengths of (110)[1 −10], (661)[1 −10], (441)[1 −10], (331)[1 −10], (221)[1 −10], (332)[1 −10], (443)[1 −10], (554)[1 −10] and (111)[1 −10] at a $\phi_2$=45° cross section in the three-dimensional texture.

The average for the ratios of the X-ray strength in the orientation component group of {110}<110> to {111}<110> to random X-ray diffraction strength means the arithmetic average for the ratios of the X-ray strength in the above orientation components to random X-ray diffraction strength. When the X-ray strengths in not all the above orientation components are obtained, the arithmetic average of the X-ray strengths of the orientation components of {110}<110>, {441}<110> and {221}<110> may be used as a substitute. Among these orientation components, {110}<110> is important and it is particularly desirable that the ratio of the X-ray strength in this orientation component to random X-ray diffraction strength be 3.0 or more. Needless to say, it is better yet, especially for a steel pipe for hydroforming use, if the average for the ratios of X-ray strength in the orientation component group of {110}<110> to {111}<110> to random X-ray diffraction strength is 2.0 or more and, at the same time, the ratio of X-ray strength in the orientation component of {110}<110> to random X-ray diffraction strength is 3.0 or more.

Further, in the case where the shape of a product requires a comparatively large amount of axial compression in a mode of forming work, it is desirable that the average for the ratios of the X-ray strength in the above orientation group to random X-ray diffraction strength be 3.5 or more and the ratio of the X-ray strength in the orientation component of {110}<110> to random X-ray diffraction strength be 5.0 or more.

In the invention according to the item (11), it is necessary that the texture of the steel pipe satisfies one or more of the following conditions ① to ③:

① at least one or more of the following ratios being 3.0 or more: the ratio of the X-ray strength in the orientation component of {111}<110> to random X-ray diffraction strength on a plane at the wall thickness center; the average for the ratios of the X-ray strength in the orientation component group of {110}<110> to {332}<110> to random X-ray diffraction strength on a plane at the wall thickness center; and the ratio of the X-ray strength in the orientation component of {110}<110> to random X-ray diffraction strength on a plane at the wall thickness center, ② at least either one or both of the following ratios being 3.0 or less: the average for the ratios of the X-ray strength in the orientation component group of {100}<110> to {223}<110> to random X-ray diffraction strength on a plane at the wall thickness center; and the ratio of the X-ray strength in the orientation component of {100}<110> to random X-ray diffraction strength on a plane at the wall thickness center, and ③ at least either one or both of the following conditions being satisfied: the average for the ratios of the X-ray strength in the orientation component group of {111}<110> to {111}<112> and {554}<225> to random X-ray diffraction strength on a plane at the wall thickness center being 2.0 or more; and the ratio of the X-ray strength in the orientation component of {111}<110> to random X-ray diffraction strength on a plane at the wall thickness center being 3.0 or more.

Regarding the limitation of the X-ray strengths in the orientation components in the condition (1), even if the orientation component of {111}<110> among the orientation component group of {110}<110> to {111}<110> is omitted from the arithmetic average, the effects of the present invention are retained.

That is to say, the high formability (a diameter expansion ratio of 1.25 or more under different hydroforming conditions) intended in the present invention can be achieved if at least one or more of the following ratios is/are 3.0 or more, on a plane at the wall thickness center: the ratio of the X-ray strength in the orientation component of {111}<110> to random X-ray diffraction strength; the average for the ratios of the X-ray strength in the orientation component group of {110}<110> to {332}<110> to random X-ray diffraction strength; and the ratio of the X-ray strength in the orientation component of {110}<110> to random X-ray diffraction strength.

As described above, at least the ratios of the X-ray strength in the orientation component group of {110}<110> to {332}<110> and the orientation component of {110}<110> to random X-ray diffraction strength on a plane at the wall thickness center are important characteristic figures for forming by the hydroforming method.

Regarding the limitation of the X-ray strengths in the orientation components in the condition (2), when at least the average for the ratios of the X-ray strength in the orientation component group of {100}<110> to {223}<110> to random X-ray diffraction strength on a plane at the wall thickness center exceeds 3.0, or at least the ratio of the X-ray strength in the orientation component of {100}<110> to random X-ray diffraction strength on a plane at the wall thickness center exceeds 3.0, the diameter expansion ratio or the like particularly in hydroforming, which is an object of the present invention, deteriorates to about 1.2 or less. For this reason, the value of each of the above is limited to 3.0 or less.

Regarding the limitation of the X-ray strengths in the orientation components in condition (3), when the average for the ratios of the X-ray strength in the orientation component group of {111}<110> to {111}<112> and {554}<225> to random X-ray diffraction strength on a plane at the wall thickness center is below 2.0 or the ratio of the X-ray strength in the orientation component of {111}<110> to random X-ray diffraction strength on a plane at the wall thickness center is below 3.0, the diameter expansion ratio in hydroforming also tends to become low. For this reason, it is necessary to secure the degrees of convergence of 2.0 or more and 3.0 or more, respectively, in the above. Thus, together with the conditions ① and ②, it is necessary to satisfy at least one or more of the conditions ① to ③ for securing the formability in hydroforming.

The ratios of the X-ray strength in the above orientation components are measured by X-ray diffraction measurement on a plane at the wall thickness center and calculating the ratios of X-ray strength in the orientation components to the X-ray diffraction strength of a random crystal.

The main orientation components included in the above orientation component groups are explained below.

The main orientation components included in the orientation component group of {110}<110> to {332}<110> are {110}<110>, {661}<110>, {441}<110>, {331}<110>, {221}<110>, {332}<110>, {443}<110> and {554}<110>.

The main orientation components included in the orientation component group of {100}<110> to {223}<110> are {100}<110>, {116}<110>, {114}<110>, {113}<110>, {112}<110>, {335}<110> and {223}<110>.

The main orientation components included in the orientation component group of {111}<110> to {111}<112> are {111}<110> and {111}<112>.

The ratios of the X-ray strength in these orientation components to random X-ray diffraction strength can be calculated from the three-dimensional texture calculated by the vector method based on the pole figure of {110}, or the three-dimensional texture calculated by the series expansion method based on two or more pole figures of {110}, {100}, {211} and {310}.

For example, the ratios of the X-ray strength in the orientation components included in the orientation component group of {110}<110> to {332}<110> to random X-ray diffraction strength can be calculated by the latter method from the strengths of (110)[1 −10], (661)[1 −10], (441)[1 −10], (331)[1 −10], (221)[1 −10], (332)[1 −10], (443)[1 −10] and (554)[1 −10] at a $\phi_2$=45° cross section in the three-dimensional texture. Likewise, in the case of the orientation component group of {100}<110> to {223}<110>, the strengths of (001)[1 −10], (116)[1 −10], (114)[1 −10], (113)[1 −10], (112)[1 −10], (335)[1 −10] and (223)[1 −10] can be used as representative figures and, in the case of the orientation component group of {111}<110> to {111}<112>, the strengths of (111)[1 −10] and (111)[−1 −12] can be used as representative figures.

In addition, when it is impossible to obtain the X-ray strength for all the above orientation components included in the orientation component group of {110}<110> to {332}<110>, which is of special importance for the purpose of the present invention, an arithmetic average in the strengths of the orientation components of (110)[1 −10], (441)[1 −10] and (221)[1 −10] can be used as a substitute.

Note that the X-ray strength of the texture of the steel pipe according to the present invention usually becomes the strongest in the range of the above orientation component group at the $\phi_2$=45° cross section and, the farther away from the above orientation component group the orientation component is, the lower the strength level thereof gradually becomes. Considering the factors such as the accuracy in X-ray measurement, axial twist during the pipe production, and the accuracy in the X-ray sample preparation, however, there may be cases where the orientation in which the X-ray strength is the strongest deviates from the above orientation component group by about ±5° to ±10°.

For the X-ray diffraction measurement of a steel pipe, arc section test pieces have to be cut out from the steel pipe and pressed into flat pieces for X-ray analysis. Further, when pressing the arc section test pieces into flat pieces, the strain must be as low as possible to avoid the influence of crystal rotation caused by the working and, for this reason, the upper limit of the amount of imposed strain is set at 10%, and the working has to be done under a strain not exceeding the figure. Then, the tabular test pieces thus prepared are ground to a prescribed thickness by mechanical polishing and then conditioned by a chemical or other polishing method so as to remove the strain and expose the thickness center layer for the X-ray diffraction measurement.

Note that, when a segregation band is found in the wall thickness center layer, the measurement may be done at an area free from segregation anywhere in the range from ⅜ to ⅝ of the wall thickness. Further, even when no segregation band is found, it is acceptable for the purpose of the present invention if a texture specified in claims of the present invention is obtained at a plane other than the plane at the wall thickness center and, for instance, in the above range from ⅜ to ⅝ of the wall thickness. Additionally, when the X-ray diffraction measurement is difficult, the EBSP or ECP technique may be employed for the measurement.

Although the texture of the present invention is specified in terms of the result of the X-ray measurement at a plane at the wall thickness center or near it as stated above, it is preferable that the steel pipe have a similar texture also in wall thickness portions other than near the thickness center. However, there may be cases where the texture in the range from the outer surface to ¼ or so of the wall thickness does not satisfy the requirements described above, because the texture changes as a result of shear deformation during the diameter reduction work explained hereafter.

Note that {hkl}<uvw> means that, when the test pieces for the X-ray diffraction measurement are prepared in the manner described above, the crystal orientation perpendicular to the wall surface is <hkl> and the crystal orientation along the longitudinal direction of the steel pipe is <uvw>.

The characteristics of the texture according to the present invention cannot be expressed using common inverse pole figures and conventional pole figures only, but it is preferable that the ratios of the X-ray strength in the above orientation components to random X-ray diffraction strength be as specified below when, for example, the inverse pole figures expressing the radial orientations of the steel pipe are measured at portions near the wall thickness center: 2 or less in <100>, 2 or less in <411>, 4 or less in <211>, 15 or less in <111>, 15 or less in <332>, 20.0 or less in <221> and 30.0 or less in <110>.

In the inverse pole figures expressing the axial orientation, the preferred figures of X-ray strength ratios are as follows: 10 or more in the <110> orientation and 3 or less in all the orientations other than the <110> orientation.

Then, the invention according to the item (9) is explained hereafter.

N-value: It is sometimes the case in hydroforming that working is applied to a work piece isotropically to some extent and, accordingly, it is necessary to secure the n-value in the longitudinal and/or circumferential directions of the steel pipe. For this reason, the lower limit of n-value is set at 0.12 for both the directions. The effects of the present invention are realized without setting an upper limit of n-value specifically.

In the present invention, n-value is defined as the value obtained at an amount of strain of 5 to 10% or 3 to 8% in the tensile test method according to Japanese Industrial Standard (JIS).

Next, the invention according to the item (10) is explained hereafter.

R-value: Since hydroforming includes working with material influx through the application of axial compression and, hence, for securing workability at the portions subjected to this kind of working, the lower limit of the r-value in the longitudinal direction of a steel pipe is set at 1.1. The effects of the present invention are realized without setting an upper limit of r-value specifically.

In the present invention, r-value is defined as the value obtained at an amount of strain of 10% or 5% in the tensile test according to JIS.

The reasons for limiting the chemical composition in the invention according to the items (2) to (7) and (15) to (18) are explained hereafter.

Al, Zr and Mg: These are deoxidizing elements. Among these, Al contributes to the enhancement of formability especially when box annealing is employed. An excessive addition of these elements causes the crystallization and precipitation of oxides, sulfides and nitrides in quantities, deteriorating steel cleanliness and ductility. Besides, it remarkably spoils a plating property. For this reason, it is determined to add one or more of these elements if necessary, at 0.0001 to 0.50% in total, or within the limits of 0.0001 to 0.5% for Al, 0.0001 to 0.5% for Zr and 0.0001 to 0.5% for Mg.

Nb, Ti and V: Any of Nb, Ti and V, which are added if necessary, increases steel strength by forming carbides, nitrides or carbonitrides when added at 0.001% or more, either singly or in total of two or more of them. When their total content or the content of any one of them exceeds 0.5%, they precipitate in great quantities in the grains of ferrite, which is the base phase, or at the grain boundaries in the form of carbides, nitrides or carbonitrides, deteriorating ductility. The addition range of Nb, Ti and V is, therefore, limited to at 0.001 to 0.5% in single addition or in total of two or more of them.

P: P is an element effective for enhancing steel strength, but it deteriorates weldability and resistance to delayed crack of slabs as well as fatigue resistance and ductility. For this reason, P is determined to be added only when necessary and the range of its addition is limited to at 0.001 to 0.20%.

B: B, which is added if necessary, is effective for strengthening grain boundaries and increasing steel strength. When its addition amount exceeds 0.01%, however, the above effect is saturated and, what is more, steel strength is increased more than necessary and workability is deteriorated in addition. For this reason, the content of B is limited to at 0.0001 to 0.01%.

Ni, Cr, Cu, Co, Mo and W: These are steel hardening elements and therefore 0.001% or more of these elements is added, if necessary, either singly or in total of two or more of them. Since an excessive addition of these elements lowers ductility, their addition range is limited to at 0.001 to 1.5% in a single addition or in a total of two or more of them.

Ca and a rare earth element (Rem): They are elements effective for the control of inclusions, and their addition in an appropriate amount increases hot workability. Their excessive addition, however, causes hot shortness, and thus the range of their addition is defined as at 0.0001 to 0.5% in single addition or in total of two or more of them, as required. Here, the rare earth elements (Rems) include Y, Sr and the lanthanoids. Industrially, it is economical to add these elements in the form of mischmetal, which is a mixture of them.

N: N is effective for increasing steel strength and it may be added at 0.0001% or more. Its addition in a large quantity is, however, not desirable for the control of welding defects and, for this reason, the upper limit of its addition amount is set at 0.03%.

Hf and Ta: Hf and Ta, which are added if necessary, increase steel strength through the formation of carbides, nitrides or carbonitrides when added at 0.001% or more each. When added in excess of 2.0%, however, they precipitate in quantities in the grains of ferrite, which is the base phase, or at the grain boundaries in the form of the carbides, nitrides or carbonitrides, deteriorating ductility. The addition range of Hf and Ta, therefore, is defined as at 0.001 to 2.0% each.

The effects of the present invention are not hindered even when O, Sn, S, Zn, Pb, As, Sb, etc. are included in the steel pipe as unavoidable impurities as long as each addition amount is within the range of at 0.01% or less.

Crystal grain size: The control of crystal grain size is important for controlling texture. It is necessary for intensifying the X-ray strength in the orientation component of {110}<110>, particularly in the invention according to the items (8) to (12), to control the grain size of main phase ferrite to 0.1 to 200 $\mu$m. The orientation component of {110}<110> is most important for enhancing formability in the orientation component group of {110}<110> to {332}<110>. Thus, even if the grain size of ferrite is mixed in a wide range, for example in a metallographic structure in which the portions consisting of ferrite grains 0.1 to 10 $\mu$m in size and those consisting of ferrite grains 10 to 100 $\mu$m in size exist in a mixture, the effects of the present invention are maintained as long as a high X-ray strength is obtained in the orientation component of {110}<110>. Here, the ferrite grain size is measured by the section method compliant to JIS.

By the way, for measuring the size and the aspect ratio of ferrite grains, it is necessary to make grain boundaries clearly identifiable. Ferrite grain boundaries can be clearly identified by using a 2 to 5% nitral solution in the case of steels having a comparatively high carbon content, or a special etching solution, SULC-G, in the case of ultra-low carbon steels (such as IF steels), after finishing a section surface, for observation, with polishing diamond having a roughness of several micrometers or by buffing.

The special etching solution can be prepared by dissolving 2 to 10 g of dodecylbenzenesulfonic acid, 0.1 to 1 g of oxalic acid and 1 to 5 g of picric acid in 100 ml of water and then adding 2 to 3 ml of 6N hydrochloric acid. In the structure obtained through the above techniques, ferrite grain boundaries appear and their sub-grains also may appear partially.

The ferrite grain boundaries meant here are the interfaces rendered visible to a light-optical microscope by the above sample preparation processes, including the interfaces such as the sub-grains appearing partially. The size and aspect ratio of ferrite grains are measured with respect to the grain boundaries thus observed. The ferrite grains are measured through image analysis of 20 or more fields of view of 100 to 500-power magnification, and the grain size, aspect ratio, etc. are calculated on the basis of this measurement. The area percentage of ferrite is measured assuming that the ferrite grains are spherical. Note that the value of area percentage is nearly equal to that of volume percentage.

The material of the steel pipe according to the present invention may also contain structures such as pearlite, bainite, martensite, austenite, carbonitrides, etc. as metallographic structures other than ferrite. For the purpose of securing steel ductility, however, the percentage of these hard phases is limited to below 50%. The range of the grain size of ferrite is determined to be from 0.1 to 200 μm, because it is industrially difficult to obtain recrystallization grains smaller than 0.1 μm in size, and, when crystal grains larger than 200 μm are mixed, the X-ray strength in the orientation component of {110}<110> falls.

In the invention according to the items (13) and (14), in addition, the standard deviation of the grain size of ferrite grains and their aspect ratio are limited for the purpose of increasing the ratio of X-ray strength in the orientation component group of {110}<110> to {332}<110> and suppressing the ratio of X-ray strength in the orientation component group of {100}<110> to {223}<110>.

These figures are calculated through the observation of 20 or more fields of view by a light-optical microscope of 100 to 1,000-power magnification, and the standard deviation of the grain size is calculated based on the circle-equivalent diameters of the grains obtained by image analysis.

The aspect ratio is calculated from the ratio of the number of the ferrite grain boundaries crossing a line segment parallel to the direction of rolling to the number of the ferrite grain boundaries crossing a line segment of the same length perpendicular to the direction of rolling and from the following equation: aspect ratio=(the number of grain boundaries crossing the line segment perpendicular to the rolling direction)/(the number of grain boundaries crossing the line segment parallel to the rolling direction). When the standard deviation of the ferrite grain size exceeds ±40% of the average grain size, or the aspect ratio is over 3 or below 0.5, formability tends to deteriorate. For this reason, the above figures are defined as the upper and lower limits of respective items.

In the invention according to the item (13), the lower limit of the ferrite grain size is set at 1 μm for the purpose of raising the ratios of the X-ray strength in the orientation component of {111}<110> and/or the orientation component group of {111}<110> to {332}<110>.

In producing the steel pipe according to the present invention, steel is refined in a blast furnace or an electric arc furnace process, then subjected to various secondary refining processes and, subsequently, cast by an ingot casting or a continuous casting method. In the case of continuous casting, if a production process such as the one to hot-roll cast slabs without cooling is employed in combination with other production processes, the effects of the present invention are not hindered in the least.

In addition to the above, the effects of the present invention are not in the least adversely affected if the following production processes are combined in the production of the steel sheets for pipe forming: heating an ingot to a temperature from 1,050 to 1,300° C. and then hot-rolling it at a temperature in the range from not lower than 10° C. below the $Ar_3$ transformation point to lower than 120° C. above the $Ar_3$ transformation point; the application of roll lubrication during hot rolling; coiling a hot band at a temperature of 750° C. or below; the application of cold rolling; and the application of box annealing or continuous annealing after cold rolling. That is to say, a hot-rolled, cold-rolled or cold-rolled and annealed steel sheet may be used as the material steel sheet for the pipe forming.

Besides the above, the effects of the present invention are retained even when 0.01% or less of any one of O, Sn, S, Zn, Pb, As, Sb, etc. is mixed in the steel. In pipe forming, electric resistance welding, TIG welding, MIG welding, laser welding, UO press method, butt welding and other welding and pipe forming methods may be employed.

The invention according to the items (19) and (20) (a method of producing a steel pipe excellent in formability) will be explained hereafter.

The texture of a hot-rolled or cold-rolled steel sheet: It is a prerequisite for improving the formability of a steel pipe to satisfy any one or more of the following conditions ① to ④:

① at least either one or both of the following conditions being satisfied: the average for the ratios of the X-ray strength in the orientation component group of {110}<110> to {111}<110> to random X-ray diffraction strength on a plane at the wall thickness center being 2.0 or more; and the ratio of the X-ray strength in the orientation component of {110}<110> to random X-ray diffraction strength on a plane at the wall thickness center being 3.0 or more, ② at least one or more of the following ratios being 3.0 or more: the ratio of the X-ray strength in the orientation component of {111}<110> to random X-ray diffraction strength on a plane at the wall thickness center; the average for the ratios of the X-ray strength in the orientation component group of {110}<110> to {332}<110> to random X-ray diffraction strength on a plane at the wall thickness center; and the ratio of the X-ray strength in the orientation component of {110}<110> to random X-ray diffraction strength on a plane at the wall thickness center, ③ at least either one or both of the following ratios being 3.0 or less: the average for the ratios of the X-ray strength in the orientation component group of {100}<110> to {223}<110> to random X-ray diffraction strength on a plane at the wall thickness center; and the ratio of the X-ray strength in the orientation component of {100}<110> to random X-ray diffraction strength on a plane at the wall thickness center, and ④ at least either one or both of the following conditions being satisfied: the average for the ratios of the X-ray strength in the orientation component group of {111}<110> to {111}<112> and {554}<225> to random X-ray diffraction strength on a plane at the wall thickness center being 2.0 or more; and the ratio of the X-ray strength in the orientation component of {111}<110> to random X-ray diffraction strength on a plane at the wall thickness center being 3.0 or more.

Heating temperature: In order to improve the formability of weld joints, the heating temperature before diameter reduction is set at the $Ac_3$ transformation point or above and, in order to prevent crystal grains from becoming coarse, the heating temperature is limited to 200° C. above the $Ac_3$ transformation point or below.

Temperature of diameter reduction work: In order to facilitate the recovery from the strain hardening after the diameter reduction, the temperature during diameter reduction work is set at 650° C. or higher and, in order to prevent crystal grains from becoming coarse, the temperature is limited to 900° C. or below.

Temperature of heat treatment after pipe forming: The heat treatment is applied for the purpose of recovering the ductility of a steel pipe lowered by the strain during pipe forming. When the temperature is below 650° C., a sufficient ductility recovery effect is not forthcoming, but, when the temperature exceeds 200° C. above the $Ac_3$ transformation point, coarse crystal grains become conspicuous and the surface quality of the steel pipe is remarkably deteriorated.

For this reason, the temperature is limited in the range from 650° C. to 200° C. above the $Ac_3$ transformation point.

In the above production process of welded steel pipe, solution heat treatment may be applied locally as deemed necessary for obtaining required characteristics at the heat affected zones of the welded seam, independently or in combination, and several times repeatedly, if necessary. This will enhance the effects of the present invention yet further. The heat treatment is meant for the application only to the welded seam and the heat affected zones, and it can be applied on-line during the pipe forming or off-line. The effects of the present invention are not in the least hindered if diameter reduction or homogenizing heat treatment prior to the diameter reduction is applied to the steel pipe. Further, it is desirable for improving formability to apply lubrication during the diameter reduction process; the lubrication helps realize the effects of the present invention, as it enables the production of a steel pipe excellent in forming workability in which the degree of convergence of the X-ray strength in the orientation component of {111}<110> and/or the orientation component group of {110}<110> to {332}<110> is enhanced all across the wall thickness, as a product in which the texture, especially in the surface layer, is controlled to the ranges specified in the claims of the present invention.

The invention according to the item (21) will be explained hereafter.

The N-value in longitudinal and/or circumferential direction(s) of steel pipe: This is important for enhancing the workability in hydroforming and similar working without causing the breakage or buckling of a work piece and, for this reason, an n-value is determined to be 0.18 or more in the longitudinal and/or circumferential direction(s). It is often the case that, depending on the mode of deformation during forming work, the amount of deformation is uneven in the longitudinal or circumferential direction. In order to secure good workability under different working methods, it is desirable that n-value be 0.18 or more in the longitudinal and circumferential directions.

In the case of extremely heavy working, it is desirable that n-value be 0.20 or more in both the longitudinal and circumferential directions. The effects of the present invention can be obtained without defining an upper limit of n-value specifically. There are, however, cases that, depending on the process of working, a high r-value is required in the longitudinal direction of a steel pipe. In such a case, in consideration of the conditions of diameter reduction work and other factors, it may become desirable to control n-value to 0.3 or less and increase the r-value in the longitudinal direction of the steel pipe.

The invention according to the item (22) will be explained hereafter.

R-value in longitudinal direction of steel pipe: According to past research, such as a report in the $50^{th}$ Japanese Joint Conference for the Technology of Plasticity (in 1999, p. 447 of its proceedings), the influence of r-value on the working by hydroforming was analyzed using simulations, and the r-value in the longitudinal direction was found effective in T-shape forming, one of the fundamental deformation modes of hydroforming. Besides the above, at the FISITA World Automotive Congress, 2000A420 (Jun. 12–15, 2000, at Seoul), it was reported that the r-value in the longitudinal direction could be enhanced by increasing the ratio of diameter reduction.

Even when the r-value in the longitudinal direction is enhanced by increasing the ratio of diameter reduction, however, if the n-value, another important characteristic figure for formability, is lowered, that does not mean an improvement in the workability of a steel pipe in a practical sense. On the other hand, as the size of work pieces increased, it became necessary to secure formability, not only in the portions where, like in T-shape forming, hydroforming or similar working was done so as to secure a sufficient material influx, but also in the portions where the material influx was comparatively small. In such a situation, the present inventors discovered that, while it was necessary to maintain a high n-value, it was effective to reduce the ratio of diameter reduction or conduct the diameter reduction work at a comparatively high temperature so as to lower the r-value in the longitudinal direction.

When the r-value in the longitudinal direction is below 2.2, it becomes easy to secure a desired level of n-value in the longitudinal and/or circumferential directions) in commercial production and, for this reason, the upper limit of the r-value is set at 2.2.

The lower limit of r-value is set at 0.6 or more from the viewpoint of securing formability.

The invention according to the item (23) is explained hereafter.

Texture: In order to secure formability, the following two conditions must be satisfied:

① the average for the ratios of the X-ray strength in the orientation component group of {110}<110> to {111}<110> to random X-ray diffraction strength on a plane at the wall thickness center being 1.5 or more; and ② the ratio of the X-ray strength in the orientation component of {110}<110> to random X-ray diffraction strength on a plane at the wall thickness center being 5.0 or less.

Outside the above ranges, it is possible that n-value may deteriorate.

In addition, in order to enhance formability and realize a good balance between n-value and r-value, it is desirable that the ratio of X-ray strength in the orientation component of {111}<110> to random X-ray diffraction strength be 3.0 or more on a plane at the wall thickness center.

The ratio of the X-ray strength in the orientation component of {111}<110> is important in the average for the ratios of the X-ray strength in the orientation component group of {110}<110> to {111}<110> to random X-ray diffraction strength. It is particularly desirable that the ratio of the X-ray strength to random X-ray diffraction strength be 3.0 or more in this orientation component, especially when products having a complicated shape or a large size are formed.

Needless to say, when the average for the ratios of the X-ray strength in the orientation component group of {110}<110> to {111}<110> to random X-ray diffraction strength is 2.0 or more and the ratio of the X-ray strength in the orientation component of {111}<110> to random X-ray diffraction strength is 3.0 or more, such a steel pipe is better still, especially for hydroforming use.

The orientation component of {110}<110> is also an important orientation component. For securing good values of ductility and the n-values in the longitudinal and circumferential directions of the steel pipe, however, it is necessary that the ratio of the X-ray strength in the orientation component of {110}<110> to random X-ray diffraction strength be 5.0 or less and, for this reason, its upper limit is set at 5.0.

Note that {hkl}<uvw> means that, when the test pieces for the X-ray diffraction measurement are prepared in the manner described above, the crystal orientation perpendicular to the wall surface is <hkl> and the crystal orientation along the longitudinal direction of the steel pipe is <uvw>.

The principal orientations included in these orientation components and orientation component groups are the same as those explained in the item (1).

Crystal grain size and aspect ratio: Since it is difficult to obtain crystal grains smaller than 0.1 μm in size industrially, and formability is adversely affected when there are crystal grains larger than 200 μm, these figures are defined as the lower and upper limits, respectively, of the grain size, the same as in the invention according to the item (12). The range of aspect ratio is defined as explained in the item (14).

Next, the reasons for limiting the chemical composition of the invention according to the item (27) and the successive items are explained.

The reasons for limiting the chemical composition are the same as in the section of the invention according to the item (1) explained before.

In addition to the above, the content of N is specified for the following reason.

N: N is effective for strengthening steel and thus it is added at 0.0001% or more, but since its addition in a large quantity is not desirable for the control of welding defects, the upper limit of its content is set at 0.03%.

The reasons for limiting the chemical composition of the invention according to the items (27) to (33) are the same as those explained in relation to the inventions according to the items (2) to (7) and (15) to (18).

Ni, Cr, Cu, Co, Mo and W: As an excessive addition of these elements causes the deterioration of ductility, the addition amount of these elements is limited to at 0.001 to 5.0% in single addition or in total of two or more of them.

Further, the effects of the present invention are not hindered even if 0.01% or less of any of O, Sn, S, Zn, Pb, As, Sb, etc. is included as an unavoidable impurity.

Next, the invention according to the item (34) will be explained hereafter. The reasons for limiting production conditions are the same as those of the invention according to the item (19) except for the following.

After being formed, a mother pipe is heated to a temperature from 50° C. below the $Ac_3$ transformation point to 200° C. above the $Ac_3$ transformation point and undergoes diameter reduction work at 650° C. or higher at a diameter reduction ratio of 40% or less.

Whereas a heating temperature lower than 50° C. below the $Ac_3$ transformation point causes the deterioration of ductility and the undesirable formation of texture, a heating temperature higher than 200° C. above the $Ac_3$ transformation point causes the deterioration of surface properties owing to oxidation, besides the formation of coarse crystal grains. For this reason, the heating temperature is limited to the range specified above.

In addition, the temperature of the diameter reduction work is limited as described above because, when the temperature is lower than 650° C., n-value is lowered. No upper limit is set forth specifically for the temperature of the diameter reduction work, but it is desirable to limit it to880° C. or below for fear that the surface properties may deteriorate owing to oxidation. Besides, when the diameter reduction ratio exceeds 40%, the decrease in n-value becomes conspicuous and it is feared that ductility and surface properties are deteriorated. For these reasons, the diameter reduction ratio is limited as specified above. The lower limit of the diameter reduction ratio is set at 10% for accelerating the formation of texture.

The diameter reduction ratio is the value obtained by subtracting the quotient of the outer diameter of a product pipe divided by the diameter of a mother pipe from 1, and it means the amount by which the diameter is reduced through the working.

It is desirable for improving formability to use lubrication on the diameter reduction work. The lubrication furthers the effects of the present invention, since it makes the texture especially in the surface layer conform to the range specified in the present invention, enhances the degree of convergence of the X-ray strengths to the orientation component of {111}<110> and/or the orientation component group of {111}<110> to {111}<110> throughout the wall thickness and appropriately suppresses the degree of convergence of the X-ray strengths to the orientation component of {110}<110> and, accordingly, makes it possible to produce a high strength steel pipe excellent in formability by applying various forming modes of hydroforming and similar forming methods.

EXAMPLE

Example 1

The steels of the chemical compositions shown in Tables 1 on 4 were refined on a laboratory scale, heated to 1,200° C., hot-rolled into steel sheets 2.2 and 7 mm in thickness at a finish rolling temperature from 10° C. below the $Ar_3$ transformation point, which is determined by the chemical composition and cooling rate of steel, to less than 120° C. above the $Ar_3$ transformation point (roughly 900° C.). Some of the steel sheets thus obtained were used for pipe forming and others for cold rolling.

Some of the cold-rolled steel sheets were further subjected to an annealing process to obtain cold-rolled and annealed steel sheets 2.2 mm in thickness. Then, the steel sheets were formed, in the cold, into steel pipes 108 to 49 mm in outer diameter by TIG, laser or electric resistance welding. Thereafter, the steel pipes were heated to a temperature from the $Ac_3$ transformation point to 200° C. above it and subjected to diameter reduction work at 900 to 650° C. to obtain high strength steel pipes 75 to 25 mm in outer diameter.

Forming work by hydroforming under the condition of an axial compression amount of 1 mm at 100 bar/mm was applied to the steel pipes finally obtained until they burst. A scribed circle 10 mm in diameter was transcribed on each steel pipe beforehand, and the strain $\epsilon\phi$ in the longitudinal direction of the pipe and the strain $\epsilon\theta$ in the circumferential direction were measured near the fracture or the portion of the maximum wall thickness reduction. Then the diameter expansion ratio at which the ratio of the two strains $\rho=\epsilon\phi/\epsilon\theta$ was equal to −0.5 (the value was negative because the wall thickness decreased) was calculated, and the diameter expansion ratio was used as an indicator of the formability in hydroforming for the evaluation of the product pipes.

X-ray analysis was carried out on flat test pieces prepared by cutting out arc section test pieces from the steel pipes and then pressing them. The relative X-ray strength of the test pieces was obtained through the comparison with the X-ray strength of a random crystal. The n-values in the longitudinal and circumferential directions were measured at a strain amount of 5 to 10% or 3 to 8% and the r-values in the above directions at a strain amount of 10 or 5% on arc section test pieces cut out for the respective purposes.

Tables 1 to 4 show, for each of the steels, the ratios of the X-ray strength in the orientation component of {110}<110> and the orientation component group of {110}<110> to {111}<110> to random X-ray diffraction strength and the diameter expansion ratio (the ratio of the pipe diameter at the portion where the expression $\rho=\epsilon\phi/\epsilon\theta=-0.5$ was true at the time of bursting to the initial diameter) at which each steel pipe burst during hydroforming.

Each of invented steels A to U demonstrated a relative X-ray strength in the orientation component of {110}<110> of 3.0 or more, an average for the ratios of the X-ray strength in the orientation component group of {110}<110> to {111}<110> to random X-ray diffraction strength of 2.0 or more and a diameter expansion ratio as good as more than 1.25.

The relative X-ray strength in the orientation component of {110}<110> in any of invented steels NA to NG was higher than those of invented steels A to U and the diameter expansion ratio was as good as more than 1.3 in most of them, despite the pipe materials being hot-rolled steel sheets.

In contrast, in the comparative steels, namely in high-C steel V, high-Mg steel W, high-Nb steel X, high-B steel Z, high-Mo steel AA and high-Rem steel BB, the ratios of the X-ray strength in the orientation component of {110}<110> and the orientation component group of {110}<110> to {111}<110> to random X-ray diffraction strength were low and the diameter expansion ratio was also low. On the other hand, in high-P steel Y, although the relative X-ray strength in the orientation component of {110}<110> was high, the workability of its welded joint was low and, consequently, the diameter expansion ratio was low.

Table 5 shows the relation between the area percentages of ferrite by grain size range and the diameter expansion ratio of steels A, B and P. The grain size distribution was measured on specimens for light-optical microscope observation prepared by etching a section surface parallel to the direction of rolling by the etching method explained before and using a dual image processing analyzer. In these steels, the structure of which was a mixed grain structure, the X-ray strength in the orientation component of {110}<110> was higher than that in other orientation components and the diameter expansion ratio was also high.

TABLE 1

| Steel | C | Si | S | Mn | Al | Zr | Mg | Ti | V | Nb | P | B | Cr | Cu | Ni | Mo | Co | W | Ca | Rem |
|---|---|---|---|---|---|---|---|---|---|---|---|---|---|---|---|---|---|---|---|---|
| A | 0.045 | 0.15 | 0.006 | 0.3 | | | | | | | | | | | | | | | | |
| A | " | " | " | " | | | | | | | | | | | | | | | | |
| B | 0.055 | 0.6 | 0.005 | 0.1 | 0.005 | | | | | | 0.005 | | | | | | | | | |
| B | " | " | " | " | " | | | | | | " | | | | | | | | | |
| B | " | " | " | " | " | | | | | | " | | | | | | | | | |
| B | " | " | " | " | " | | | | | | " | | | | | | | | | |
| B | " | " | " | " | " | | | | | | " | | | | | | | | | |
| C | 0.028 | 0.01 | 0.007 | 0.3 | 0.041 | | | | | | 0.025 | | | | | | | | | |
| C | " | " | " | " | " | | | | | | " | | | | | | | | | |
| C | " | " | " | " | " | | | | | | " | | | | | | | | | |
| C | " | " | " | " | " | | | | | | " | | | | | | | | | |
| D | 0.056 | 0.03 | 0.006 | 0.3 | 0.052 | | | | | | 0.12 | | | | | | | | | |
| D | " | " | " | " | " | | | | | | " | | | | | | | | | |
| D | " | " | " | " | " | | | | | | " | | | | | | | | | |
| D | " | " | " | " | " | | | | | | " | | | | | | | | | |
| E | 0.002 | 0.05 | 0.004 | 0.4 | 0.01 | 0.005 | | | | | | | | | | | | | | |
| E | " | " | " | " | " | " | | | | | | | | | | | | | | |
| F | 0.036 | 0.05 | 0.003 | 0.2 | 0.006 | | 0.0025 | | | | | | | | | | | | | |
| F | " | " | " | " | " | | " | | | | | | | | | | | | | |
| F | " | " | " | " | " | | " | | | | | | | | | | | | | |
| F | " | " | " | " | " | | " | | | | | | | | | | | | | |
| G | 0.002 | 0.05 | 0.005 | 0.2 | 0.04 | | | 0.05 | | | 0.01 | | | | | | | | | |
| G | " | " | " | " | " | | | " | | | " | | | | | | | | | |
| G | " | " | " | " | " | | | " | | | " | | | | | | | | | |
| G | " | " | " | " | " | | | " | | | " | | | | | | | | | |

| Steel | Seam welding method for pipe Forming | Average relative X-ray strength in orientation component group of {110}<110> – {111}<110> | Relative X-ray strength in orientation component of {110}<110> | Diameter expansion ratio at bursting by HF | | Heating temperature before diameter reduction /° C. | |
|---|---|---|---|---|---|---|---|
| A | Laser | 2.6 | 4.1 | 1.3 | Invented steel-cold | 770 | A |
| A | Laser | 2.5 | 3.9 | 1.3 | Invented steel-hot | 770 | A |
| B | Laser | 2.8 | 4.2 | 1.3 | Invented steel-cold | 770 | B |
| B | ERW | 2.7 | 4.1 | 1.26 | Invented steel-cold | 770 | B |
| B | ERW | 2.6 | 4.2 | 1.25 | Invented steel-hot | 770 | B |
| B | ERW | 5.3 | 10.5 | 1.31 | Invented steel-cold | 850 | B |
| B | ERW | 5.2 | 9.8 | 1.3 | Invented steel-hot | 850 | B |
| C | Laser | 2.2 | 3.9 | 1.35 | Invented steel-cold | 750 | C |
| C | ERW | 2.3 | 4 | 1.34 | Invented steel-cold | 750 | C |
| C | TIG | 2.3 | 4 | 1.38 | Invented steel-cold | 750 | C |
| C | TIG | 2.3 | 3.9 | 1.36 | Invented steel-hot | 750 | C |

TABLE 1-continued

| | | | | | | | | |
|---|---|---|---|---|---|---|---|---|
| D | Laser | 2.2 | 3.5 | 1.27 | Invented steel-cold | 700 | D |
| D | ERW | 2.2 | 3.6 | 1.26 | Invented steel-cold | 700 | D |
| D | ERW | 4.6 | 5.6 | 1.32 | Invented steel-hot | 840 | D |
| D | ERW | 6.3 | 7.6 | 1.31 | Invented steel-cold | 840 | D |
| E | Laser | 2.2 | 4 | 1.27 | Invented steel-cold | 700 | E |
| E | Laser | 2.1 | 3.9 | 1.26 | Invented steel-hot | 700 | E |
| F | Laser | 2.3 | 3.8 | 1.26 | Invented steel-cold | 750 | F |
| F | Laser | 2.2 | 3.7 | 1.25 | Invented steel-hot | 750 | F |
| F | Laser | 4.5 | 6.3 | 1.29 | Invented steel-hot | 770 | F |
| F | Laser | 5.1 | 7 | 1.28 | Invented steel-cold | 770 | F |
| G | Laser | 2.6 | 4.1 | 1.37 | Invented steel-cold | 700 | G |
| G | Laser | 2.3 | 3.8 | 1.32 | Invented steel-hot | 700 | G |
| G | Laser | 3.5 | 5.6 | 1.35 | Invented steel-cold | 835 | G |
| G | Laser | 4.5 | 3.9 | 1.34 | Invented steel-hot | 835 | G |

TABLE 2

(continued from Table 1)

| Steel | C | Si | S | Mn | Al | Zr | Mg | Ti | V | Nb | P | B | Cr | Cu | Ni | Mo | Co | W | Ca | Rem |
|---|---|---|---|---|---|---|---|---|---|---|---|---|---|---|---|---|---|---|---|---|
| H | 0.002 | 0.07 | 0.006 | 0.3 | 0.046 | | | 0.03 | | 0.02 | 0.01 | | | | | | | | | |
| H | " | " | " | " | " | | | " | | " | " | | | | | | | | | |
| I | 0.02 | 0.1 | 0.005 | 0.2 | 0.03 | | | | 0.1 | | | | | | | | | | | |
| I | " | " | " | " | " | | | | " | | | | | | | | | | | |
| J | 0.002 | 0.05 | 0.003 | 0.2 | 0.035 | | | 0.02 | | 0.02 | 0.02 | 0.0006 | | | | | | | | |
| J | " | " | " | " | " | | | " | | " | " | " | | | | | | | | |
| J | " | " | " | " | " | | | " | | " | " | " | | | | | | | | |
| J | " | " | " | " | " | | | " | | " | " | " | | | | | | | | |
| K | 0.023 | 0.1 | 0.004 | 0.2 | 0.036 | | | | | | 0.01 | | 0.2 | | | | | | | |
| K | " | " | " | " | " | | | | | | " | | " | | | | | | | |
| L | 0.003 | 0.05 | 0.006 | 0.2 | 0.038 | | | 0.04 | | | 0.01 | | | 0.2 | 0.1 | | | | | |
| L | " | " | " | " | " | | | " | | | " | | | " | " | | | | | |
| M | 0.002 | 0.1 | 0.003 | 0.3 | 0.044 | | | 0.04 | | | 0.015 | | | | | 0.5 | | | | |
| M | " | " | " | " | " | | | " | | | " | | | | | " | | | | |
| M | " | " | " | " | " | | | " | | | " | | | | | " | | | | |
| M | " | " | " | " | " | | | " | | | " | | | | | " | | | | |
| N | 0.02 | 0.09 | 0.002 | 0.2 | 0.06 | | | | | | | | | | | | 0.2 | | | |
| O | 0.003 | 0.08 | 0.003 | 0.1 | 0.05 | | | 0.05 | | | | | | | | | | 0.5 | | |
| P | 0.051 | 0.6 | 0.004 | 0.7 | 0.036 | | | | | | 0.02 | | | | | | | | 0.002 | |
| P | " | " | " | " | " | | | | | | " | | | | | | | | " | |
| P | " | " | " | " | " | | | | | | " | | | | | | | | " | |
| Q | 0.048 | 0.5 | 0.008 | 0.6 | 0.045 | | | | | | 0.008 | | | | | | | | | 0.0005 |
| Q | " | " | " | " | " | | | | | | " | | | | | | | | | " |
| R | 0.07 | 0.8 | 0.006 | 1.2 | 0.04 | | | | | | | | | | | | | | | |

| Steel | Seam welding method for pipe forming | Average relative X-ray strength in orientation component group of {110}<110> – {111}<110> | Relative X-ray strength in orientation component of {110}<110> | Diameter expansion ratio at bursting by HF | | Heating temperature before diameter reduction /° C. | |
|---|---|---|---|---|---|---|---|
| H | Laser | 2.7 | 4.3 | 1.36 | Invented steel-cold | 750 | H |
| H | Laser | 2.5 | 3.7 | 1.31 | Invented steel-hot | 750 | H |
| I | Laser | 2.3 | 3.6 | 1.28 | Invented steel-cold | 750 | I |
| I | Laser | 2.2 | 3.4 | 1.26 | Invented steel-hot | 750 | I |

TABLE 2-continued (continued from Table 1)

| | | | | | | | |
|---|---|---|---|---|---|---|---|
| J | Laser | 2.3 | 4 | 1.34 | Invented steel-cold | 750 | J |
| J | Laser | 2.2 | 3.6 | 1.3 | Invented steel-hot | 750 | J |
| J | Laser | 4.5 | 8.1 | 1.32 | Invented steel-hot | 850 | J |
| J | Laser | 6 | 9.1 | 1.33 | Invented steel-cold | 850 | J |
| K | Laser | 2.2 | 3.6 | 1.28 | Invented steel-cold | 750 | K |
| K | Laser | 2.2 | 3.5 | 1.28 | Invented steel-hot | 750 | K |
| L | Laser | 2.3 | 3.5 | 1.27 | Invented steel-cold | 700 | L |
| L | Laser | 2.3 | 3.6 | 1.26 | Invented steel-hot | 700 | L |
| M | Laser | 2.4 | 3.9 | 1.31 | Invented steel-cold | 750 | M |
| M | Laser | 2.3 | 4 | 1.3 | Invented steel-hot | 750 | M |
| M | Laser | 7.5 | 10.1 | 1.32 | Invented steel-cold | 850 | M |
| M | Laser | 6.5 | 10 | 1.33 | Invented steel-hot | 850 | M |
| N | Laser | 2.6 | 4.1 | 1.3 | Invented steel-cold | 750 | N |
| O | Laser | 2.5 | 4.2 | 1.34 | Invented steel-cold | 750 | O |
| P | Laser | 2.7 | 4.5 | 1.34 | Invented steel-cold | 750 | P |
| P | Laser | 5.6 | 7.5 | 1.36 | Invented steel-cold | 900 | P |
| P | ERW | 6.5 | 8.5 | 1.36 | Invented steel-hot | 900 | P |
| Q | Laser | 2.7 | 4.2 | 1.31 | Invented steel-cold | 750 | Q |
| Q | Laser | 2.7 | 4.3 | 1.31 | Invented steel-hot | 750 | Q |
| R | Laser | 2.2 | 3.5 | 1.27 | Invented steel-cold | 700 | R |

TABLE 3

(continued from Table 2)

| Steel | C | Si | S | Mn | Al | Zr | Mg | Ti | V | Nb | P | B | Cr | Cu | Ni | Mo | Co | W | Ca | Rem |
|---|---|---|---|---|---|---|---|---|---|---|---|---|---|---|---|---|---|---|---|---|
| S | 0.002 | 0.1 | 0.005 | 1.1 | 0.04 | | | 0.04 | | | | | | | | | | | | |
| T | 0.02 | 0.1 | 0.005 | 1 | 0.05 | | | | | | | | | | | | | | | |
| U | 0.002 | 0.1 | 0.006 | 0.9 | 0.03 | | | 0.05 | | | 0.09 | | | | | | | | | |
| V | 0.32 | 0.3 | 0.003 | 1 | 0.026 | | | | | | 0.01 | | | | | | | | | |
| V | " | " | " | " | " | | | | | | " | | | | | | | | | |
| V | " | " | " | " | " | | | | | | " | | | | | | | | | |
| V | " | " | " | " | " | | | | | | " | | | | | | | | | |
| W | 0.025 | 0.05 | 0.003 | 0.2 | 0.008 | | 0.6 | | | | | | | | | | | | | |
| W | " | " | " | " | " | | " | | | | | | | | | | | | | |
| X | 0.052 | 0.6 | 0.006 | 0.7 | 0.032 | | | | | 2.1 | 0.013 | | | | | | | | | |
| X | " | " | " | " | " | | | | | " | " | | | | | | | | | |
| Y | 0.05 | 0.1 | 0.009 | 0.3 | 0.045 | | | | | | 0.45 | | | | | | | | | |
| Y | " | " | " | " | " | | | | | | " | | | | | | | | | |
| Y | " | " | " | " | " | | | | | | " | | | | | | | | | |
| Y | " | " | " | " | " | | | | | | " | | | | | | | | | |

| Steel | Seam welding method for pipe forming | Average relative X-ray strength in orientation component group of {110}<110> – {111}<110> | Relative X-ray strength in orientation component of {110}<110> | Diameter expansion ratio at bursting by HF | | Heating temperature before diameter reduction /° C. | |
|---|---|---|---|---|---|---|---|
| S | Laser | 2.8 | 4.1 | 1.3 | Invented steel-cold | 750 | S |

TABLE 3-continued (continued from Table 2)

| | | | | | | | |
|---|---|---|---|---|---|---|---|
| T | Laser | 2.3 | 3.8 | 1.29 | Invented steel-cold | 750 | T |
| U | Laser | 2.6 | 4.2 | 1.32 | Invented steel-cold | 750 | U |
| V | Laser | 0.02 | 0.05 | 1.18 | Comparative steel-cold: C outside range | 700 | V |
| V | ERW | 0.02 | 0.04 | 1.15 | Comparative steel-cold: C outside range | 700 | V |
| V | ERW | 0.02 | 0.03 | 1.14 | Comparative steel-hot: C outside range | 700 | V |
| V | TIG | 0.03 | 0.05 | 1.22 | Comparative steel-cold: C outside range | 800 | V |
| W | Laser | 0.05 | 0.03 | 1.02 | Comparative steel-cold: Mg outside range | 770 | W |
| W | Laser | 0.04 | 0.03 | 1.03 | Comparative steel-hot: Mg outside range | 770 | W |
| X | Laser | 0.03 | 0.03 | 1.07 | Comparative steel-cold: Nb outside range | 770 | X |
| X | Laser | 0.02 | 0.03 | 1.05 | Comparative steel-hot: Nb outside range | 770 | X |
| Y | Laser | 2.1 | 3.2 | 1.05 | Comparative steel-cold: P outside range | 750 | Y |
| Y | ERW | 2 | 3.2 | 1.1 | Comparative steel-cold: P outside range | 800 | Y |
| Y | TIG | 2.1 | 3.1 | 1.08 | Comparative steel-cold: P outside range | 750 | Y |
| Y | TIG | 2 | 3 | 1.12 | Comparative steel-hot: P outside range | 800 | Y |

TABLE 4

(continued from Table 3)

| Steel | C | Si | S | Mn | Al | Zr | Mg | Ti | V | Nb | P | B | Cr | Cu | Ni | Mo | Co | W | Ca | Rem |
|---|---|---|---|---|---|---|---|---|---|---|---|---|---|---|---|---|---|---|---|---|
| Z | 0.048 | 0.5 | 0.008 | 0.5 | 0.041 | | | | | | 0.03 | 0.1 | | | | | | | | |
| Z | " | " | " | " | " | | | | | | " | " | | | | | | | | |
| AA | 0.049 | 0.5 | 0.01 | 0.8 | 0.023 | | | | | | 0.02 | | | | | 2 | | | | |
| AA | " | " | " | " | " | | | | | | " | | | | | " | | | | |
| BB | 0.046 | 0.5 | 0.003 | 0.8 | 0.033 | | | | | | 0.02 | | | | | | | | | 0.55 |
| BB | " | " | " | " | " | | | | | | " | | | | | | | | | " |
| NA | 0.007 | 0.01 | 0.014 | 0.1 | 0.03 | | | | | | | | | | | | | | | |
| NA | " | " | " | " | " | | | | | | | | | | | | | | | |
| NB | 0.012 | 0.01 | 0.005 | 0.5 | 0.04 | | | | | | 0.011 | | | | | | | | | |
| NB | " | " | " | " | " | | | | | | " | | | | | | | | | |
| NC | 0.051 | 0.01 | 0.001 | 0.3 | 0.05 | | | | | | | | | | | | | | | |
| ND | 0.002 | 0 | 0.005 | 0.1 | 0.031 | | | 0.06 | | | 0.007 | | | | | | | | | |
| NE | 0.055 | 0.02 | 0.016 | 0.2 | 0.044 | | | | | | | | | | | | | | | |
| NF | 0.002 | 0.01 | 0.005 | 0.1 | 0.03 | | | 0.02 | | | | 0.001 | | | | | | | | |
| NG | 0.21 | 0.01 | 0.005 | 0.1 | 0.03 | | | | | | | | | | | | | | | |

TABLE 4-continued (continued from Table 3)

| Steel | Seam welding method for pipe forming | Average relative X-ray strength in orientation component group of {110}<110> – {111}<110> | Relative X-ray strength in orientation component of {110}<110> | Diameter expansion ratio at bursting by HF | | Heating temperature before diameter reduction /° C. | |
|---|---|---|---|---|---|---|---|
| Z | Laser | 0.02 | 0.05 | 1.1 | Comparative steel-cold: B outside range | 770 | Z |
| Z | Laser | 0.02 | 0.06 | 1.07 | Comparative steel-hot: B outside range | 770 | Z |
| AA | Laser | 0.05 | 0.15 | 1.12 | Comparative steel-cold: Mo outside range | 770 | AA |
| AA | Laser | 0.04 | 0.1 | 1.11 | Comparative steel-hot: Mo outside range | 770 | AA |
| BB | Laser | 0.04 | 0.2 | 1.15 | Comparative steel-cold: REM outside range | 770 | BB |
| BB | Laser | 0.03 | 0.15 | 1.15 | Comparative steel-hot: REM outside range | 770 | BB |
| NA | Laser | 3.1 | 5.6 | 1.36 | Invented steel-hot | 950 | NA |
| NA | ERW | 5.1 | 10 | 1.39 | Invented steel-hot | 950 | NA |
| NB | Laser | 4.9 | 8.3 | 1.37 | Invented steel-hot | 850 | NB |
| NB | ERW | 7.1 | 11.5 | 1.39 | Invented steel-hot | 980 | NB |
| NC | ERW | 6.3 | 10.5 | 1.36 | Invented steel-hot | 840 | NC |
| ND | ERW | 3.9 | 5.7 | 1.34 | Invented steel-hot | 840 | ND |
| NE | ERW | 4 | 6.9 | 1.35 | Invented steel-hot | 840 | NE |
| NF | ERW | 3.6 | 7.5 | 1.33 | Invented steel-hot | 880 | NF |
| NG | ERW | 3 | 6.3 | 1.26 | Invented steel-hot | 840 | NG |

TABLE 5

| Steel | Area percentage of grains 0.1–10 μm in size | Area percentage of grains over 10–200 μm in size | Diameter expansion ratio | Average relative X-ray strength in orientation component group of {110}<110> – {111}<110> | X-ray strength ratio in orientation component of {110}<110> |
|---|---|---|---|---|---|
| A | 30 | 70 | 1.3 | 3.5 | 4.1 |
| B | 20 | 80 | 1.3 | 3.7 | 4.2 |
| P | 15 | 80* | 1.34 | 3.9 | 4.5 |

| Steel | {111}<110> | {110}<110> – {332}<110> | {100}<110> – {223}<110> | {100}<110> | {111}<110> – {111}<112> + {554}<225> |
|---|---|---|---|---|---|
| A | 3 | 4 | 0.5 | 0 | 1 |
| B | 3 | 4.1 | 0.5 | 0 | 1 |
| P | 3 | 4.2 | 0.5 | 0 | 1 |

*Ferrite + bainite in steel P

Example 2

The steels of the chemical compositions shown in Tables 6 and 7 were refined on a laboratory scale, heated to 1,200° C., hot-rolled into steel sheets 2.2 and 7 mm in thickness at a finish rolling temperature from 10° C. below the $Ar_3$ transformation point, which is determined by the chemical composition and cooling rate of the steel, to less than 120° C. above the $Ar_3$ transformation point (roughly 900° C.). Some of the steel sheets thus obtained were used for pipe forming and others for cold rolling.

Some of the cold-rolled steel sheets were further subjected to an annealing process to obtain cold-rolled and annealed steel sheets 2.2 mm in thickness. Then the steel sheets were formed in the cold into steel pipes 108 to 49 mm in outer diameter by electric resistance welding. Thereafter, high strength steel pipes were produced in the following manner: heating some of the steel pipes to the temperatures shown in Tables 8 and 9 and then subjecting them to diameter reduction work up to an outer diameter of 75 to 25 mm at the temperatures also shown in Tables 8 and 9; and subjecting the others to heat treatment after the pipe forming.

Hydroforming work was applied to the steel pipes finally obtained until they burst. The hydroforming was applied at different amounts of axial compression and inner pressure through the control of these parameters until the pipes burst or buckled. Then, the longitudinal strain $\epsilon\phi$ and circumferential strain $\epsilon\theta$ were measured at the portion showing the largest diameter expansion ratio (diameter expansion ratio= the largest circumference after forming/the circumference of mother pipe) and the portion near the fracture or the portion of the maximum wall thickness reduction. The ratio of the two strains $\rho=\epsilon\phi/\epsilon\theta$ and the maximum diameter expansion ratio were plotted, and the diameter expansion ratio at which the value of $\epsilon\phi/\epsilon\theta$ was −0.5 (the value was negative as the wall thickness decreased) was calculated. This diameter expansion ratio was also used for the evaluation of the steel pipes as another indicator of the formability in hydroforming.

Tables 8 and 9 also show the characteristics of the steels. The steels the matrices of which had the X-ray strength, n-values and r-values falling within the respective ranges specified in the present invention demonstrated high diameter expansion ratios. The pipes heated to above the $Ac_3$ transformation point for the diameter reduction also showed high diameter expansion ratios. With respect to the area percentage and grain size distribution of ferrite, most of the steels had ferrite as the main phase and an average grain size of 100 μm or less. As can be understood from the average grain size and its standard deviation, the ferrite grains 0.1 μm or less or 200 μm or more in size were not seen in them.

On the other hand, in the cases where the heating temperature before the diameter reduction or the temperature during the diameter reduction work was low (steels NDD, NFF and NJJ), the diameter expansion ratio was low. In high-C steel CNNA, high-Nb steel CNBB and high-B steel CNCC, the diameter expansion ratio was also low. Further, in steels CNAA and CNBB, the amount of hard phases was high and their crystal grain sizes could not be measured accurately.

TABLE 6

| Steel | C | Si | Mn | P | Facultative elements | Kind of steel sheet and seam welding method | {111}<110> |
|---|---|---|---|---|---|---|---|
| NAA | 0.124 | 0.01 | 0.41 | 0.01 | 0.03Al | Hot-rolled, ERW | 5.6 |
| NAA | " | " | " | " | " | Hot-rolled, ERW | 12 |
| NAA* | " | " | " | " | " | Hot-rolled, ERW | 0.5 |
| NBB | 0.08 | 0.14 | 0.38 | 0.01 | 0.02Al | Hot-rolled, ERW | 6 |
| NBB* | " | " | " | " | " | Hot- rolled, ERW | 0.5 |
| NCC | 0.01 | 0.01 | 0.11 | 0.02 | 0.04Al | Hot-rolled, ERW | 8 |
| NCC* | " | " | " | " | " | Hot-rolled, ERW | 1.5 |
| NDD | 0.002 | 0.02 | 0.95 | 0.07 | 0.04Al-0.05Ti | Hot-rolled, ERW | 1 |
| NDD | " | " | " | " | " | Hot-rolled, ERW | 7 |
| NDD* | " | " | " | " | " | Cold-rolled, ERW | 4 |
| NEE | 0.002 | 0.01 | 0.2 | 0.02 | 0.03Al-0.04Ti | Cold-rolled, ERW | 11 |
| NEE* | " | " | " | " | " | Cold-rolled, ERW | 5 |
| NFF | 0.003 | 0.02 | 0.2 | 0.02 | 0.03Al-0.02Nb-0.03Ti-0.0018B | Hot-rolled, ERW | 1.2 |
| NFF | " | " | " | " | " | Cold-rolled, ERW | 9 |

| Steel | {110}<110> − {332}<110> | {110}<110> | {100}<110> − {223}<110> | {100}<110> | {111}<110> − {111}<112> + {554}<225> |
|---|---|---|---|---|---|
| NAA | 9.5 | 11 | 1.9 | 2.8 | 1.9 |
| NAA | 14 | 8 | 2.8 | 2 | 4 |
| NAA* | 1 | 0.5 | 1 | 1.5 | 0.5 |
| NBB | 10 | 9 | 1.5 | 2 | 2 |
| NBB* | 0.5 | 0.5 | 1 | 1 | 1 |
| NCC | 10 | 11 | 1.5 | 1 | 2.5 |
| NCC* | 1 | 0.5 | 0.5 | 0.5 | 1 |
| NDD | 1.5 | 0.3 | 10.5 | 3.5 | 0.8 |
| NDD | 8.5 | 9 | 2.3 | 1.5 | 2 |
| NDD* | 3 | 0 | 1 | 0 | 3.5 |
| NEE | 6.3 | 3 | 3 | 2 | 9 |
| NEE* | 3.5 | 0 | 1 | 0 | 4 |

TABLE 6-continued

| | | | | | |
|---|---|---|---|---|---|
| NFF | 1.9 | 0.4 | 8.9 | 4 | 1 |
| NFF | 5.1 | 2.5 | 2.8 | 3 | 7 |

*Mainly of ferrite, the rest consisting mostly of carbides, nitrides and inclusions. The carbonitrides include cementite and all alloy carbonitrides (e.g., TiC and TiN in steels containing Ti). The inclusions include all the oxides and sulfides precipitating or crystallizing during refining, solidification, hot-rolling, etc., although it-is difficult to measure the area percentages of all the precipitates and crystals accurately by a light-optical microscope. Thus, when the area percentage of these second phases is small and it is difficult to measure it accurately, ferrite accounts for over 90% of the area percentage, and, in this case, the area percentage of ferrite is shown as "over 90%".

TABLE 7

(continued from Table 6)

| Steel | C | Si | Mn | P | Facultative elements | Kind of steel sheet and seam welding method | {111}<110> |
|---|---|---|---|---|---|---|---|
| NGG | 0.05 | 0.6 | 1 | 0.03 | 0.05Nb | Hot-rolled, ERW | 2 |
| NHH | 0.003 | 0.1 | 0.3 | 0.02 | 0.4Hf | Cold-rolled, ERW | 9 |
| NII | 0.0015 | 0.05 | 0.07 | 0.03 | 0.3Ta | Hot-rolled, ERW | 2.5 |
| NJJ | 0.002 | 0.02 | 0.1 | 0.02 | 1.3Cu-0.6Ni | Hot-rolled, ERW | 2.7 |
| NJJ | " | " | " | " | " | Hot-rolled, ERW | 2.5 |
| NJJ | " | " | " | " | " | Cold-rolled, ERW | 6 |
| NKK | 0.04 | 0.5 | 1.5 | 0.02 | 0.05Ti-0.0005Ca-0.03Al | Hot-rolled, ERW | 2 |
| NLL | 0.05 | 0.6 | 0.8 | 0.02 | 0.05Ti-0.0025Mg-0.03Al | Hot-rolled, ERW | 2.2 |
| NMM | 0.002 | 0.1 | 0.3 | 0.01 | 0.05Ti-0.0030Mg-0.01Al | Cold-rolled, ERW | 10 |
| CNAA | 0.45 | 0.2 | 0.2 | 0.01 | | Hot-rolled, ERW | 1 |
| CNBB | 0.05 | 0.6 | 0.8 | 0.02 | 1.0Nb | Hot-rolled, ERW | 0.5 |
| CNCC | 0.002 | 0.02 | 0.2 | 0.01 | 0.05Nb-0.05Ti-0.07B | Cold-rolled, ERW | 1.4 |

| Steel | {110}<110> − {332}<110> | {110}<110> | {100}<110> − {223}<110> | {100}<110> | {111}<110> − {111}<112> + {554}<225> |
|---|---|---|---|---|---|
| NGG | 5.2 | 3 | 3.1 | 1 | 0.7 |
| NHH | 5.6 | 3.5 | 2.7 | 2.5 | 4.8 |
| NII | 6 | 3.5 | 3.4 | 2 | 0.6 |
| NJJ | 2.5 | 0.5 | 8.2 | 5 | 0.3 |
| NJJ | 7 | 5 | 2 | 0.5 | 2 |
| NJJ | 5 | 3.5 | 1.5 | 0.5 | 5 |
| NKK | 5.5 | 4.5 | 1.8 | 0.4 | 0.7 |
| NLL | 6 | 4 | 2 | 0.5 | 0.7 |
| NMM | 6 | 2.5 | 2.5 | 2 | 8 |
| CNAA | 0.5 | 0.4 | 10 | 8 | 0.5 |
| CNBB | 0.2 | 0.3 | 11 | 7 | 0.5 |
| CNCC | 1.5 | 2.5 | 7.5 | 4.5 | 0.5 |

*Mainly of ferrite, the rest consisting mostly of carbides, nitrides and inclusions. The carbonitrides include cementite and all alloy carbonitrides (e.g., Tic and TiN in steels containing Ti). The inclusions include all the oxides and sulfides precipitating or crystallizing during refining, solidification, hot-rolling, etc., although it is difficult to measure the area percentages of all the precipitates and crystals accurately by a light-optical microscope. Thus, when the area percentage of these second phases is small and it is difficult to measure it accurately, ferrite accounts for over 90% of the area percentage, and, in this case, the area percentage of ferrite is shown as "over 90%".

TABLE 8

| Steel | Average ferrite grain size/μm | Standard deviation of grain size/μm | Area percentage of ferrite grains* | Average aspect ratio of ferrite grains | Temperature of heat treatment after pipe forming/° C. | Heating temperature before diameter reduction/° C. | Finish temperature of diameter reduction/° C. | n-value in longitudinal direction |
|---|---|---|---|---|---|---|---|---|
| NAA | 12 | 4.5 | Over 90% | 2.1 | | 980 | 750 | 0.14 |
| NAA | 40 | 18 | Over 90% | 5 | | 800 | 650 | 0.11 |
| NAA* | 15 | 5 | Over 90% | 1.3 | 650 | | | 0.16 |
| NBB | 15 | 5 | Over 90% | 2.4 | | 980 | 730 | 0.14 |
| NBB* | 15 | 5 | Over 90% | 1.1 | 675 | | | 0.17 |
| NCC | 17 | 6 | Over 90% | 3 | | 950 | 735 | 0.16 |
| NCC* | 25 | 8 | Over 90% | 1.4 | 700 | | | 0.17 |
| NDD | 20 | 5 | Over 90% | 5.6 | | 750 | 640 | 0.11 |
| NDD | 22 | 9 | Over 90% | 3 | | 950 | 750 | 0.16 |
| NDD* | 25 | 9 | Over 90% | 1.5 | 650 | | | 0.17 |
| NEE | 25 | 9.3 | Over 90% | 3.5 | | 900 | 750 | 0.17 |
| NEE* | 27 | 9 | Over 90% | 1.5 | 650 | | | 0.17 |
| NFF | 15 | 5 | Over 90% | 2.7 | | 750 | 600 | 0.11 |
| NFF | 24 | 7 | Over 90% | 2.9 | | 900 | 730 | 0.15 |

| Steel | n-value in circumferential direction | r-value in longitudinal direction | Maximum diameter expansion ratio when $\epsilon\phi/\epsilon\theta = 0.5$ | |
|---|---|---|---|---|
| NAA | 0.13 | 2.5 | 1.48 | Invented steel |
| NAA | 0.09 | 1.8 | 1.31 | Invented steel |
| NAA* | 0.15 | 0.9 | 1.3 | Invented steel |
| NBB | 0.13 | 3.1 | 1.55 | Invented steel |
| NBB* | 0.16 | 0.9 | 1.3 | Invented steel |
| NCC | 0.15 | 3.8 | 1.59 | Invented steel |
| NCC* | 0.17 | 1.2 | 1.38 | Invented steel |
| NDD | 0.1 | 0.4 | 1.08 | Comparative steel |
| NDD | 0.14 | 3.2 | 1.53 | Invented steel |
| NDD* | 0.17 | 1.3 | 1.4 | Invented steel |
| NEE | 0.15 | 2.3 | 1.46 | Invented steel |
| NEE* | 0.17 | 1.8 | 1.4 | Invented steel |
| NFF | 0.1 | 0.5 | 1.1 | Comparative steel |
| NFF | 0.12 | 2 | 1.43 | Invented steel |

*Mainly of ferrite, the rest consisting mostly of carbides, nitrides and inclusions. The carbonitrides include cementite and all alloy carbonitrides (e.g., TiC and TiN in steels containing Ti). The inclusions include all the oxides and sulfides precipitating or crystallizing during refining, solidification, hot-rolling, etc., although it is difficult to measure the area percentages of all the precipitates and crystals accurately by a light-optical microscope. Thus, when the area percentage of these second phases is small and it is difficult to measure it accurately, ferrite accounts for over 90% of the area percentage, and, in this case, the area percentage of ferrite is shown as "over 90%".

TABLE 9

(continued from Table 8)

| Steel | Average ferrite grain size/μm | Standard deviation of grain size/μm | Area percentage of ferrite grains* | Average aspect ratio of ferrite grains | Temperature of heat treatment after pipe forming/° C. | Heating temperature before diameter reduction/° C. | Finish temperature of diameter reduction/° C. | n-value in longitudinal direction |
|---|---|---|---|---|---|---|---|---|
| NGG | 14 | 5 | 84% | 2.3 | | 950 | 840 | 0.12 |
| NHH | 20 | 4 | Over 90% | 2.1 | | 900 | 750 | 0.13 |
| NII | 15 | 5 | Over 90% | 2.5 | | 930 | 800 | 0.13 |
| NJJ | 20 | 6 | Over 90% | 2.8 | | 830 | 630 | 0.1 |
| NJJ | 27 | 8 | Over 90% | 2.4 | | 980 | 750 | 0.13 |
| NJJ | 25 | 6 | Over 90% | 2.2 | | 980 | 750 | 0.13 |
| NKK | 13 | 4 | Over 90% | 1.9 | | 910 | 770 | 0.11 |
| NLL | 10 | 4 | Over 90% | 1.9 | | 920 | 780 | 0.11 |
| NMM | 20 | 7 | Over 90% | 2.9 | | 900 | 750 | 0.16 |
| CNAA | Not measurable | | | | | 930 | 800 | 0.05 |
| CNBB | Not measurable | | | | | 950 | 830 | 0.06 |
| CNCC | 23 | 6 | Over 90% | 3.5 | | 800 | 600 | 0.1 |

TABLE 9-continued (continued from Table 8)

| Steel | n-value in circumferential direction | r-value in longitudinal direction | Maximum diameter expansion ratio when $\epsilon\phi/\epsilon\theta = 0.5$ | |
|---|---|---|---|---|
| NGG | 0.11 | 1.9 | 1.39 | Invented steel |
| NHH | 0.12 | 2.1 | 1.4 | Invented steel |
| NII | 0.11 | 2 | 1.39 | Invented steel |
| NJJ | 0.08 | 0.7 | 1.18 | Comparative steel |
| NJJ | 0.12 | 2.1 | 1.4 | Invented steel |
| NJJ | 0.12 | 2.2 | 1.4 | Invented steel |
| NKK | 0.1 | 2.3 | 1.42 | Invented steel |
| NLL | 0.09 | 2.2 | 1.4 | Invented steel |
| NMM | 0.14 | 2.3 | 1.44 | Invented steel |
| CNAA | 0.04 | 0.8 | 1.05 | Comparative steel |
| CNBB | 0.05 | 0.7 | 1.05 | Comparative steel |
| CNCC | 0.08 | 0.9 | 1.1 | Comparative steel |

*Mainly of ferrite, the rest consisting mostly of carbides, nitrides and inclusions. The carbonitrides include cementite and all alloy carbonitrides (e.g., TiC and TiN in steels containing Ti). The inclusions include all the oxides and sulfides precipitating or crystallizing during refining, solidification, hot-rolling, etc., although it is difficult to measure the area percentages of all the precipitates and crystals accurately by a light-optical microscope. Thus, when the area percentage of these second phases is small and it is difficult to measure it accurately, ferrite accounts for over 90% of the area percentage, and, in this case, the area percentage of ferrite is shown as "over 90%".

Example 3

The steels of the chemical compositions shown in Tables 10 and 11 were rolled into hot-rolled and cold rolled steel sheets 2.2 mm in thickness under the same conditions as in Example 1. The steel sheets were formed into steel pipes 108 or 89.1 mm in outer diameter by TIG, laser or electric resistance welding, then heated and subjected to diameter reduction to obtain high strength steel pipes 63.5 to 25 mm in outer diameter.

Hydroforming work was applied to the steel pipes finally obtained until they burst. Then the diameter expansion ratio at which the ratio $\rho=\epsilon\phi/\epsilon\theta$ of the strain $\epsilon\phi$ in the longitudinal direction of the pipe and the strain $\epsilon\theta$ in the circumferential direction near the fracture or in the portion of the maximum wall thickness reduction was −0.1 to −0.2 (the value was negative as the wall thickness decreased) was calculated, and this diameter expansion ratio was used as an indicator of the formability in hydroforming for the evaluation of the product pipes.

X-ray analysis was carried out on flat test pieces prepared by cutting out arc section test pieces from the steel pipes and then pressing them. The relative X-ray strength of the test pieces was obtained through the comparison with the X-ray strength of a random crystal.

Tables 12 and 13 show, for each steel, the n-values in the longitudinal and circumferential directions, the r-values in the longitudinal direction, the ratios of the X-ray strength in different orientation components and the maximum diameter expansion ratios (=maximum diameter at the time of burst/initial diameter) until the steel pipes burst at the hydroforming.

In invented steels A to O, the n-value(s) in the longitudinal and/or circumferential directions was/were 0.18 or more and the r-value in the longitudinal direction was less than 2.2 except for steel A which was formed into pipes by laser welding.

Further, in the invented steels, the average for the ratios of the X-ray strength in the orientation component group of {110}<110> to {111}<110> to random X-ray diffraction strength was 1.5 or more and the relative X-ray strength in the orientation component of {110}<110> was 5.0 or less and, moreover, in some of them, the relative X-ray strength in the orientation component of {111}<110> was 3.0 or more. As a result, a good diameter expansion ratio over 1.30 was obtained in them.

In high-C steel CA, high-Mg steel CB, high-Nb steel CC, high-B steel CE and high-Cr steel CF, in contrast, n-value was low in both the longitudinal and circumferential directions and the diameter expansion ratio was also low. These steels, except for steel CE, showed low ratios of the X-ray strength in the orientation components {110}<110> and/or {111}<110> and the orientation component group of {110}<110> to {111}<110> to random X-ray diffraction strength, and the diameter expansion ratio was lower still. Aside from the above, weld defects occurred during the pipe forming of high-P steel CD and high-Ca+Rem steel CG, demonstrating the difficulty in the pipe forming by a mass production facility.

TABLE 10

| Steel | C | Si | S | Mn | Al | N | Zr | Mg | Ti | V | Nb | P | B | Cr | Cu |
|---|---|---|---|---|---|---|---|---|---|---|---|---|---|---|---|
| A | 0.05 | 0.2 | 0.005 | 0.4 | 0.02 | 0.002 | | | | | | 0.005 | | | |
| B | 0.048 | 0.05 | 0.005 | 0.75 | 0.05 | 0.0045 | | | | | | 0.02 | | | |
| C | 0.002 | 0.04 | 0.003 | 0.1 | 0.02 | 0.0025 | 0.09 | | | | | | | | |
| D | 0.002 | 0.05 | 0.006 | 0.4 | 0.03 | 0.0026 | | 0.0011 | 0.06 | | | 0.01 | | | |
| E | 0.0032 | 0.03 | 0.004 | 0.7 | 0.045 | 0.0029 | | | 0.02 | | 0.02 | 0.05 | 0.0008 | | |

TABLE 10-continued

| | | | | | | | | | | | | | | |
|---|---|---|---|---|---|---|---|---|---|---|---|---|---|---|
| F | 0.13 | 0.05 | 0.005 | 0.84 | 0.03 | 0.0023 | | | | | | | | |
| G | 0.035 | 0.4 | 0.004 | 1.4 | 0.02 | 0.0061 | | | | 0.16 | | 0.03 | | |
| H | 0.08 | 0.2 | 0.004 | 1.2 | 0.03 | 0.0036 | | | 0.07 | | | 0.03 | | |
| I | 0.0025 | 0.05 | 0.005 | 0.25 | 0.04 | 0.0032 | | | 0.04 | | | 0.04 | | 0.9 |
| J | 0.005 | 1 | 0.003 | 0.7 | 0.03 | 0.0035 | | | 0.01 | | 0.02 | 0.02 | 0.2 | |
| K | 0.11 | 0.2 | 0.002 | 1.4 | 0.04 | 0.003 | | | | | 0.047 | | | |
| L | 0.05 | 1.8 | 0.003 | 1.5 | 0.05 | 0.0036 | | | | | | | | |
| M | 0.17 | 1.3 | 0.003 | 1.2 | 0.03 | 0.0032 | | | | | | 0.03 | | |
| N | 0.05 | 1.5 | 0.002 | 1.1 | 0.04 | 0.0025 | | | | | 0.08 | 0.02 | | |
| O | 0.09 | 1 | 0.003 | 0.9 | 0.03 | 0.0031 | | | 0.01 | | 0.04 | 0.03 | | |

| Steel | Ni | Mo | Co | W | Ca | Rem | |
|---|---|---|---|---|---|---|---|
| A | | | | | | | Invented steel |
| B | | | | | | | Invented steel |
| C | | | | | | | Invented steel |
| D | | | | | | | Invented steel |
| E | | | | | | | Invented steel |
| F | | | | | | | Invented steel |
| G | | | | | | | Invented steel |
| H | | | | | | | Invented steel |
| I | 0.3 | | | | | | Invented steel |
| J | | 0.1 | | 0.1 | | | Invented steel |
| K | | | | | | | Invented steel |
| L | | | | | 0.001 | 0.0002 | Invented steel |
| M | | | 0.3 | | | | Invented steel |
| N | | | | | | | Invented steel |
| O | | | | | | | Invented steel |

TABLE 11

(continued from Table 10)

| Steel | C | Si | S | Mn | Al | N | Zr | Mg | Ti | V | Nb | P | B | Cr |
|---|---|---|---|---|---|---|---|---|---|---|---|---|---|---|
| CA | 0.47 | 0.2 | 0.003 | 0.9 | 0.03 | 0.0025 | | | | | | 0.01 | | |
| CB | 0.002 | 0.05 | 0.002 | 0.1 | 0.005 | 0.0035 | | 0.6 | 0.05 | | | | | |
| CC | 0.15 | 0.05 | 0.003 | 0.8 | 0.04 | 0.0025 | | | | | 1.9 | 0.02 | | |
| CD | 0.12 | 0.05 | 0.009 | 1.4 | 0.05 | 0.003 | | | 0.08 | | | 0.35 | | |
| CE | 0.0025 | 0.05 | 0.008 | 1.2 | 0.03 | 0.003 | | | 0.02 | | 0.05 | 0.03 | 0.09 | |
| CF | 0.05 | 0.1 | 0.01 | 1 | 0.03 | 0.007 | | | | | | 0.03 | | 9.1 |
| CG | 0.05 | 0.6 | 0.003 | 0.7 | 0.1 | 0.006 | | | | | | 0.02 | | |

| Steel | Cu | Ni | Mo | Co | W | Ca | Rem | |
|---|---|---|---|---|---|---|---|---|
| CA | | | | | | | | Comparative steel: C outside range |
| CB | | | | | | | | Comparative steel: Mg outside range |
| CC | | | | | | | | Comparative steel: Nb outside range |
| CD | | | | | | | | Comparative steel: P outside range |
| CE | | | | | | | | Comparative steel: B outside range |
| CF | | | 1.2 | | | | | Comparative steel: Gr, Mo outside range |
| CG | | | | | | 0.07 | 0.46 | Comparative steel: Ca, REM outside range |

TABLE 12

| Steel | Seam welding method for pipe forming | n-value in longitudinal direction | n-value in circumferential direction | r-value in longitudinal direction | Average relative X-ray strength in orientation component group of {110}<110> – {111}<110> | Relative X-ray strength in orientation component of {110}<110> | Relative X-ray strength in orientation component of {111}<110> |
|---|---|---|---|---|---|---|---|
| A | ERW | 0.26 | 0.24 | 1.3 | 3 | 2.5 | 2 |
| A | Laser | 0.18 | 0.16 | 2.3 | 2.5 | 2.9 | 2 |
| B | ERW | 0.18 | 0.19 | 2.1 | 4 | 1 | 5.6 |

TABLE 12-continued

| | | | | | | | |
|---|---|---|---|---|---|---|---|
| C | Laser | 0.2 | 0.19 | 1.5 | 3 | 0.5 | 3.5 |
| D | Laser | 0.18 | 0.19 | 1.3 | 3 | 0 | 3.5 |
| E | Laser | 0.22 | 0.2 | 1.2 | 3.5 | 0 | 4 |
| F | ERW | 0.23 | 0.21 | 1.3 | 2 | 2 | 1.5 |
| G | ERW | 0.18 | 0.17 | 1 | 2 | 1.5 | 2 |
| H | ERW | 0.2 | 0.18 | 1.5 | 2.5 | 2.5 | 2.5 |
| I | Laser | 0.19 | 0.19 | 1.4 | 3 | 0.5 | 3.5 |
| J | TIG | 0.2 | 0.18 | 1.2 | 2.5 | 0 | 3 |
| K | ERW | 0.21 | 0.18 | 1.9 | 3.5 | 2.8 | 3.2 |
| L | ERW | 0.23 | 0.2 | 2 | 3.5 | 2.8 | 2.5 |
| M | Laser | 0.21 | 0.2 | 1.2 | 2.5 | 2 | 3 |
| N | ERW | 0.2 | 0.19 | 1.2 | 2.5 | 2.5 | 2.5 |
| O | ERW | 0.21 | 0.19 | 1.3 | 2.5 | 2 | 3 |

| Steel | Diameter expansion ratio at bursting by HF | Area percentage of ferrite | Aspect ratio of ferrite | Percentage of grains 0.1–200 μm in size (%) | |
|---|---|---|---|---|---|
| A | 1.45 | Over 90% | 2.3 | 100 | Invented steel-hot |
| A | 1.38 | Over 90% | 2.5 | 100 | Invented steel-hot |
| B | 1.45 | Over 90% | 1.6 | 100 | Invented steel-cold |
| C | 1.38 | Over 90% | 1.5 | 100 | Invented steel-cold |
| D | 1.35 | Over 90% | 1.4 | 100 | Invented steel-cold |
| E | 1.41 | Over 90% | 1.4 | 100 | Invented steel-cold |
| F | 1.4 | Over 90% | 1.6 | 100 | Invented steel-hot |
| G | 1.34 | Over 90% | 1.5 | 100 | Invented steel-hot |
| H | 1.43 | 87% | 1.7 | 100 | Invented steel-hot |
| I | 1.39 | Over 90% | 1.3 | 100 | Invented steel-cold |
| J | 1.35 | Over 90% | 1.4 | 100 | Invented steel-hot |
| K | 1.4 | 84% | 1.9 | 100 | Invented steel-hot |
| L | 1.44 | Over 90% | 1.5 | 100 | Invented steel-hot |
| M | 1.41 | 82% | 1.8 | 100 | Invented steel-cold |
| N | 1.41 | Over 90% | 2.3 | 100 | Invented steel-hot |
| O | 1.42 | Over 90% | 1.5 | 100 | Invented steel-hot |

*Mainly of ferrite, the rest consisting mostly of carbides, nitrides and inclusions. The carbonitrides include cementite and all alloy carbonitrides (e.g., TiC and TiN in steels containing Ti). The inclusions include all the oxides and sulfides precipitating or crystallizing during refining, solidification, hot-rolling, etc., although it is difficult to measure the area percentages of all the precipitates and crystals accurately by a light-optical microscope. Thus, when the area percentage of these second phases is small and it is difficult to measure it accurately, ferrite accounts for over 90% of the area percentage, and, in this case, the area percentage of ferrite is shown as "over 90%".

TABLE 13

(continued from Table 12)

| Steel | Seam welding method for pipe forming | n-value in longitudinal direction | n-value in circumferential direction | r-value in longitudinal direction | Average relative X-ray strength in orientation component group of {110}<110> – {111}<110> | Relative X-ray strength in orientation component of {110}<110> | Relative X-ray strength in orientation component of {111}<110> | Diameter expansion ratio at bursting by HF |
|---|---|---|---|---|---|---|---|---|
| CA | ERW | 0.11 | 0.11 | 1 | 1.5 | 0.5 | 1 | 1.04 |
| CB | Laser | 0.11 | 0.1 | 1 | 1 | 1 | 1 | 1.03 |
| CC | Laser | 0.1 | 0.09 | 0.9 | 1 | 1 | 1 | 1.03 |
| CD | ERW | Not tested owing to cracks and weld defects during seam welding | | | | | | |
| CE | Laser | 0.1 | 0.11 | 1 | 1.5 | 0.5 | 1.4 | 1.1 |

TABLE 13-continued (continued from Table 12)

| | | | | | | | | |
|---|---|---|---|---|---|---|---|---|
| CF | TIG | 0.09 | 0.1 | 0.8 | 0.5 | 0.5 | 0.5 | 1.03 |
| CG | ERW | Not tested owing to cracks and weld defects during seam welding | | | | | | |

| Steel | Area percentage of ferrite | Aspect ratio of ferrite | Percentage of grains 0.1–200 μm in size (%) | |
|---|---|---|---|---|
| CA | Over 90% | 1.5 | 100 | Comparative steel-cold; C outside range |
| CB | Not measurable because of too fine grains | | | Comparative steel-cold; Mg outside range |
| CC | Not measurable because of too fine grains | | | Comparative steel-hot; Nb outside range |
| CD | | | | Comparative steel-cold; P outside range |
| CE | Over 90% | 4.2 | 100 | Comparative steel-cold; B outside range |
| CF | Aspect ratio and size distribution of ferrite grains not measurable owing to less than 10% of ferrite amount, over 90% being martensite or bainite. | | | Comparative steel-hot; Cr, Mo outside range |
| CG | | | | Comparative steel-hot; Ca, REM outside range |

*Mainly of ferrite, the rest consisting mostly of carbides, nitrides and inclusions. The carbonitrides include cementite and all alloy carbonitrides (e.g., TiC and TiN in steels containing Ti). The inclusions include all the oxides and sulfides precipitating or crystallizing during refining, solidification, hot-rolling, etc., although it is difficult to measure the area percentages of all the precipitates and crystals accurately by a light-optical microscope. Thus, when the area percentage of these second phases is small and it is difficult to measure it accurately, ferrite accounts for over 90% of the area percentage, and, in this case, the area percentage of ferrite is shown as "over 90%".

Example 4

Among the steels of the chemical compositions shown in Tables 10 and 11, steels A, F, H, K and L were refined on a laboratory scale, heated to 1,200° C., hot-rolled into steel sheets 2.2 mm in thickness at a finish rolling temperature from 10° C. below the $Ar_3$ transformation point, which is determined by the chemical composition and cooling rate of the steel, to less than 120° C. above the $Ar_3$ transformation point (roughly 900° C.), and the steel sheets thus produced were used as the materials for pipe forming.

The steel sheets were formed, in the cold, into steel pipes 108 or 89.1 mm in outer diameter by electric resistance welding. Thereafter, the steel pipes were subjected to diameter reduction work to obtain high strength steel pipes 63.55 to 25 mm in outer diameter at the heating temperatures and diameter reduction temperatures shown in Table 14.

Hydroforming work was applied to the steel pipes finally obtained until they burst. Then, the diameter expansion ratio at which the ratio $\rho=\epsilon\phi/\epsilon\theta$ of the strain $\epsilon\phi$ in the longitudinal direction of the pipes and the strain $\epsilon\theta$ in the circumferential direction near the fracture or in the portion of the maximum wall thickness reduction was −0.1 to −0.2 (the value was negative as the wall thickness decreased) was calculated, and this diameter expansion ratio was used as an indicator of the formability in hydroforming for the evaluation of the product pipes.

Table 14 shows the characteristics of the steels. In the steels satisfying the production conditions specified in claim 34, the n-values in the longitudinal and circumferential directions were 0.18 or more and the r-value in the longitudinal direction was less than 2.2.

Further, in these steels, the average for the ratios of the X-ray strength in the orientation component group of {110}<110> to {111}<110> to random X-ray diffraction strength was 1.5 or more and the relative X-ray strength in the orientation component of {110}<110> was 5.0 or less and, moreover, in some of them, the relative X-ray strength in the orientation component of {111}<110> was 3.0 or more. As a result, a good diameter expansion ratio over 1.30 was obtained in these steels.

In contrast, in the steels not satisfying the production conditions specified in claim 34, n-value was low in both the longitudinal and circumferential directions. However, since the steels satisfied any one of claims 1, 9, 10, 11 and 19, their diameter expansion ratios were comparatively good, roughly 1.25 or higher, if not very high in the above forming mode. The steels which underwent the diameter reduction work at a high diameter reduction ratio of 77% broke during the work.

TABLE 14

| Steel | Heating temperature for diameter reduction work after pipe forming /° C | Finish temperature of diameter reduction work/° C. | Diameter reduction ratio/% | n-value in longitudinal direction | n-value in circumferential direction | r-value in longitudinal direction | Average relative X-ray strength in orientation component group of {110}<110> – {111}110> |
|---|---|---|---|---|---|---|---|
| A | 980 | 800 | 29 | 0.26 | 0.24 | 1.3 | 3 |
| | 980 | 650 | 58 | 0.16 | 0.17 | 2.5 | 3.5 |
| | 980 | 700 | 77 | | | | |
| F | 950 | 760 | 29 | 0.23 | 0.21 | 1.3 | 2 |
| | 950 | 650 | 58 | 0.12 | 0.14 | 2.6 | 4 |
| | 870 | 800 | 29 | 0.24 | 0.22 | 1 | 2.5 |
| H | 950 | 770 | 29 | 0.2 | 0.18 | 1.5 | 2.5 |
| | 950 | 700 | 77 | | | | |
| K | 950 | 780 | 29 | 0.21 | 0.18 | 1.9 | 3.5 |
| | 950 | 650 | 58 | 0.1 | 0.09 | 2.3 | 4 |
| L | 980 | 840 | 29 | 0.23 | 0.2 | 2 | 3.5 |
| | 980 | 650 | 58 | 0.14 | 0.13 | 2.4 | 4 |

| Steel | Relative X-ray strength in orientation component of {110}<110> | Relative X-ray strength in orientation component of {111}<110> | Diameter expansion ratio at HF | |
|---|---|---|---|---|
| A | 2.5 | 2 | 1.45 | Invented example (according to claim 34) |
| | 5 | 3.5 | 1.26 | Invented example |
| | | | Broken at diameter reduction | Comparative example |
| F | 2 | 1.5 | 1.4 | Invented example (according to claim 34) |
| | 5.5 | 3 | 1.25 | Invented example |
| | 1 | 1 | 1.42 | Invented example (according to claim 34) |
| H | 2.5 | 2.5 | 1.43 | Invented example (according to claim 34) |
| | | | Broken at diameter reduction | Comparative example |
| K | 2.8 | 3.2 | 1.4 | Invented example (according to claim 34) |
| | 5.5 | 3.2 | 1.26 | Invented example |
| L | 2.8 | 2.5 | 1.44 | Invented example (according to claim 34) |
| | 4 | 3 | 1.26 | Invented example |

Industrial Applicability

The present invention makes it possible to produce a high strength steel pipe excellent in formability in hydroforming and similar forming techniques by identifying the texture of a steel material excellent in formability in hydroforming and similar forming techniques and a method of controlling the texture and by specifying the texture and the controlling method.

What is claimed is:

1. A steel pipe excellent in formability characterized by: containing, in mass, C: 0.0005 to 0.30%, Si: 0.001 to 2.0%, Mn: 0.01 to 3.0%, with the balance consisting of Fe and unavoidable impurities; and the average for the ratios of the X-ray strength in the orientation component group of {110}<110> to {111}<110> to random X-ray diffraction strength on a plane at the wall thickness center being 2.0 or more and/or the ratio of the X-ray strength in the orientation component of {110}<110> to random X-ray diffraction strength on a plane at the wall thickness center being 3.0 or more.

2. A steel pipe excellent in formability according to claim 1, characterized by further containing, in the steel, one or more of Al, Zr and Mg at 0.0001 to 0.5 mass % in total.

3. A steel pipe excellent in formability according to claim 1 or 2, characterized by further containing, in the steel, one or more of Ti, V and Nb at 0.001 to 0.5 mass % in total.

4. A steel pipe excellent in formability characterized by satisfying either one or both of the following properties:

(1) the n-value in the longitudinal direction of the pipe being 0.12 or more, and (2) the n-value in the circumferential direction of the pipe being 0.12 or more.

5. A steel pipe excellent in formability according to claim 4, characterized by having the property of the r-value in the longitudinal direction of the pipe being 1.1 or more.

6. A steel pipe excellent in formability characterized in that the texture of the steel pipe satisfies one or more of the following conditions (1) to (3):

(1) at least one or more of the following ratios being 3.0 or more: the ratio of the X-ray strength in the orientation component of {111}<110> to random X-ray diffraction strength on a plane at the wall thickness center; the average for the ratios of the X-ray strength in the orientation component group of {110}<110> to {332}<110> to random X-ray diffraction strength on a plane at the wall thickness center; and the ratio of the X-ray strength in the orientation component of {110}<110> to random X-ray diffraction strength on a plane at the wall thickness center, (2) at least either one or both of the following ratios being 3.0 or less; the average for the ratios of the X-ray strength in the orientation component group of {100}<110> to {223}<110> to random X-ray diffraction strength on a plane at the wall thickness center; and the ratio of the X-ray strength in the orientation component of {100}<110> to random X-ray diffraction strength on a plane at the wall thickness center, and (3) at least either one or both of the following conditions being satisfied: the average for the ratios of the X-ray strength in the orientation component group of {111}<110> to {111}<112> and {554}<225> to random X-ray diffraction strength on a plane at the wall thickness center being 2.0 or more; and the ratio of the X-ray strength in the orientation component of {111}<110> to random X-ray diffraction strength on a plane at the wall thickness center being 3.0 or more.

7. A steel pipe excellent formability according to any one of claims 4 to 6, characterized by containing ferrite at 50% or more in terms of area percentage and the grain size of the ferrite being in the range from 0.1 t 200 μm.

8. A steel pipe excellent in formability characterized by satisfying either one or both of the following properties:

(1) the n-value in the longitudinal direction of the pipe being 0.18 or more, and (2) the n-value in the circumferential direction of the pipe being 0.18 or more.

9. A steel pipe excellent in formability according to claim 8, characterized by having the property of the r-value in the longitudinal direction of the pipe being 0.6 or more but less than 2.2.

10. A steel pipe excellent in formability according to claim 8 or 9, characterized in that the ratio of X-ray strength to random X-ray diffraction strength satisfies the following two conditions:

(1) the average for the ratios of the X-ray strength in the orientation component group of {110}<110> to {111}<110> to random X-ray diffraction strength on a plane at the wall thickness center being 1.5 or more, and (2) the ratio of the X-ray strength in the orientation component of {110}<110> to random X-ray diffraction strength on a plane at the wall thickness center being 5.0 or less.

11. A steel pipe excellent in formability according to claim 1, characterized by further containing P at 0.001 to 0.20 mass % in the steel.

12. A steel pipe excellent in formability according to claim 1, characterized by further containing B at 0.0001 to 0.01 mass % in the steel.

13. A steel pipe excellent in formability according to claim 1, characterized by further containing, in the steel, one or more of Cr, Cu, Ni, Co, W and Mo at 0.001 to 1.5 mass % in total.

14. A steel pipe excellent in formability according to claim 1, characterized by further containing, in the steel, one or more of Ca and a rare earth element (Rem) at 0.0001 to 0.5 mass % in total.

15. A steel pipe excellent in formability according to claim 1, characterized in that: ferrite accounts for 50% or more, in terms of area percentage, of the metallographic structure; the crystal grain size of the ferrite is within the range from 0.1 to 200 μm; and the average for the ratios of the X-ray strength in the orientation component group of {110}<110> to {111}<110> to random X-ray diffraction strength on a plane at the wall thickness center is 2.0 or more and/or the ratio of the X-ray strength in the orientation component of {110}<110> to random X-ray diffraction strength on a plane at the wall thickness center is 3.0 or more.

16. A steel pipe excellent in formability according to claim 6, characterized by: containing ferrite at 50% or more in terms of area percentage; the grain size of the ferrite ranging from 1 to 200 μm; and the standard deviation of the distribution of the grain size falling within the range of ±40% of the average grain size.

17. A steel pipe excellent in formability according to claim 6, characterized by: containing ferrite at 50% or more in terms of area percentage; and the average for the aspect ratios (the ratio of the grain length in the longitudinal direction to the grain thickness in the thickness direction) of ferrite grains being in the range from 0.5 to 3.0.

18. A steel pipe excellent in formability according to claim 6, characterized by containing, in mass, C: 0.0005 to 0.30%, Si: 0.001 to 2.0%, Mn: 0.01 to 3.0%, P: 0.001 to 0.20%, and N: 0.0001 to 0.03%, with the balance consisting of Fe and unavoidable impurities.

19. A steel pipe excellent in formability according to claim 18, characterized by further containing in the steel pipe, in mass, one or more of Ti: 0.001 to 0.5%, Zr: 0.001 to 0.5% or less, Hf: 0.001 to 2.0% or less, Cr: 0.001 to 1.5% or less, Mo: 0.001 to 1.5% or less, W: 0.001 to 1.5% or less, V: 0.001 to 0.5% or less, Nb: 0.001 to 0.5% or less, Ta: 0.001 to 2.0% or less, and CO: 0.001 to 1.5% or less.

20. A steel pipe excellent in formability according to claim 18 or 19, characterized by further containing, in the steel pipe, in mass, one or more of B: 0.0001 to 0.01%, Ni: 0.001 to 1.5%, and Cu: 0.001 to 1.5%.

21. A steel pipe excellent in formability according to claim 18, characterized by further containing, in the steel pipe, in mass, one or more of Al: 0.001 to 0.5%, Ca: 0.0001 to 0.5%, Mg: 0.0001 to 0.5%, and Rem: 0.0001 to 0.5%.

22. A method of producing a steel pipe excellent in formability according to claim 1, characterized by forming a mother pipe using a hot-rolled or cold-rolled steel sheet satisfying any one or more of the following conditions (1) to (4) as the material sheet, then heating the mother pipe to a temperature in the range from the $Ac_3$ transformation point to 2000° C. above the $Ac_3$ transformation point, and then subjecting it to diameter reduction work in the temperature range from 900 to 650° C.:

(1) at least either one or both of the following conditions being satisfied: the average for the ratios of the X-ray strength in the orientation component group of {110}<110> to {111}110> to random X-ray diffraction strength on a plane at the wall thickness center being 2.0 or more; and the ratio of the X-ray strength in the orientation component of {110}<110> to random X-ray diffraction strength on a plane at the wall thickness center being 3.0 or more, (2) at least one or more of the following ratios being 3.0 or more: the ratio of the X-ray strength in the orientation component of {111}<110> to random X-ray diffraction strength on a plane at the wall thickness center; the average for the ratios of the X-ray strength in the orientation component group of {110}<110> to {332}<110> to random X-ray diffraction strength on a plane at the wall thickness center; and the ratio of the X-ray strength in the orientation component of {110}110> to random X-ray diffraction strength on a plane at the wall thickness center, (3) at least either one or both of the following ratios being 3.0 or less: the average for the ratios of the X-ray strength in the orientation component group of {100}<110> to {223}<110> to random X-ray diffraction strength on a plane at the wall thickness center; and the ratio of the X-ray strength in the orientation component of {100}<110> to random X-ray diffraction strength on a plane at the wall thickness center, and (4) at least either one or both of the following conditions being satisfied: the average for the ratios of the X-ray strength in the orientation component group of {111}<110> to {111}<112> and {554}<225> to random X-ray diffraction strength on a plane at the wall thickness center being 2.0 or more; and the ratio of the X-ray strength in the orientation component of {111}<110> to random X-ray diffraction strength on a plane at the wall thickness center being 3.0 or more.

23. A method of producing a steel pipe excellent in formability according to claim 1, characterized by forming a mother pipe using a hot-rolled or cold-rolled steel sheet satisfying any one or more of the following conditions (1) to (4) as the material sheet, and then applying heat treatment to the mother pipe at a temperature in the range of 6500° C. to 200° C. above the $Ac_3$ transformation point:

(1) at least either one or both of the following conditions being satisfied: the average for the ratios of the X-ray strength in the orientation component group of {110}<110> to {111}<110> to random X-ray diffraction strength on a plane at the wall thickness center being 2.0 or more; and the ratio of the X-ray strength in the orientation component of {110}<110> to random X-ray diffraction strength on a plane at the wall thickness center being 3.0 or more, (2) at least one or more of the following ratios being 3.0 or more: the ratio of the X-ray strength in the orientation component of {111}<110> to random X-ray diffraction strength on a plane at the wall thickness center; the average for the ratios of the X-ray strength in the orientation component group of {110}<110> to {332}<110> to random X-ray diffraction strength on a plane at the wall thickness center; and the ratio of the X-ray strength in the orientation component of {110}<110> to random X-ray diffraction strength on a plane at the wall thickness center, (3) at least either one or both of the following ratios being 3.0 or less: the average for the ratios of the X-ray strength in the orientation component group of {100}<110> to {223}<110> to random X-ray diffraction strength on a plane at the wall thickness center; and the ratio of the X-ray strength in the orientation component of {100}<110> to random X-ray diffraction strength on a plane at, the wall thickness center, and (4) at least either one or both of the following conditions being satisfied: the average for the ratios of the X-ray strength in the orientation component group of {111}<110> to {111}<112> and {554}<225> to random X-ray diffraction strength on a plane at the wall thickness center being 2.0 or more; and the ratio of the X-ray strength in the orientation component of {111}<110> to random X-ray diffraction strength on a plane at the wall thickness center being 1.5 or more.

24. A steel pipe excellent in formability according to claim 8, characterized in that the ratio of the X-ray strength in the orientation component of {111}<110> to random X-ray diffraction strength on a plane at the wall thickness center is 3.0 or more.

25. A steel pipe excellent in formability according to claim 8, characterized by containing ferrite at 50% or more in terms of area percentage and the grain size of the ferrite being in the range from 0.1 to 200 $\mu$m.

26. A steel pipe excellent in formability according to claim 8, characterized by: containing ferrite at 50% or more in terms of area percentage; and the average for the aspect ratios (the ratio of the grain length in the longitudinal direction to the grain thickness in the thickness direction) of ferrite grains being in the range from 0.5 to 3.0.

27. A steel pipe excellent in formability according to claim 8, characterized by containing, in mass, C: 0.0005 to 0.30%, Si: 0.001 to 2.0%, Mn: 0.01 to 3.0%, and N: 0.0001 to 0.03%, with the balance consisting of Fe and unavoidable impurities.

28. A steel pipe excellent in formability according to claim 27, characterized by further containing, in the steel pipe, one or more of Al, Zr and Mg at 0.0001 to 0.5 mass % in total.

29. A steel pipe excellent in formability according to claim 27, characterized by further containing1 in the steel pipe, one or more of Ti, V and Nb at 0.001 to 0.5 mass % in total.

30. A steel pipe excellent in formability according to claim 27, characterized by further containing P at 0.001 to 0.20 mass % in the steel pipe.

31. A steel pipe excellent in formability according to claim 27, characterized by further containing B at 0.0001 to 0.01 mass %, in the steel pipe.

32. A steel pipe excellent in formability according to claim 27, characterized by further containing, in the steel pipe, one or more of Cr, Cu, Ni, Co, W and Mo by 0.001 to 5.0 mass % in total.

33. A steel pipe excellent in formability according to claim 27, characterized by further containing, in the steel pipe, one or more of Ca and a rare earth element (Rem) by 0.0001 to 0.5 mass% in total.

34. A method of producing a steel pipe excellent in formability according to claim 8, characterized by forming a mother pipe, then heating it to a temperature in the range from 500° C. below the $Ac_1$ transformation point to 2000° C. above the $Ac_3$ transformation point, and then subjecting it to diameter reduction work in the temperature range from 650 to 9000° C. at a diameter reduction ratio of 10 to 40%.

* * * * *

UNITED STATES PATENT AND TRADEMARK OFFICE

CERTIFICATE OF CORRECTION

PATENT NO. : 6,866,725 B2
DATED : March 15, 2005
INVENTOR(S) : Nobuhiro Fujita et al.

It is certified that error appears in the above-identified patent and that said Letters Patent is hereby corrected as shown below:

Column 46,
Line 63, change “2000° C” to -- 200° C --.

Column 47,
Line 42, change “6500° C” to -- 650° C --.

Column 48,
Line 63, change “2000° C” to -- 200° C --.
Line 66, change “9000° C” to -- 900° C --.

Signed and Sealed this

Thirteenth Day of September, 2005

JON W. DUDAS
*Director of the United States Patent and Trademark Office*